US007100787B2

(12) United States Patent
Farnsworth et al.

(10) Patent No.: US 7,100,787 B2
(45) Date of Patent: Sep. 5, 2006

(54) BEVERAGE CONTAINER LIDS WITH A PREMIUM AND A COMBINED DISPLAY AREA AND COOLING/INSULATING STRUCTURE FOR THE PREMIUM

(75) Inventors: Donald S. Farnsworth, Oakland, CA (US); John Nava, Ojai, CA (US)

(73) Assignee: East End, Inc., Ojai, CA (US)

( * ) Notice: Subject to any disclaimer, the term of this patent is extended or adjusted under 35 U.S.C. 154(b) by 0 days.

(21) Appl. No.: 10/217,622

(22) Filed: Aug. 13, 2002

(65) Prior Publication Data

US 2004/0031797 A1 Feb. 19, 2004

(51) Int. Cl.

| | |
|---|---|
| ***B65D 51/24*** | (2006.01) |
| ***A47G 19/22*** | (2006.01) |
| *B65D 51/18* | (2006.01) |
| *B65D 51/16* | (2006.01) |

(52) U.S. Cl. ..... 220/212; 206/217; 206/308.1; 220/713; 220/254.1; 220/521; 220/367.1

(58) Field of Classification Search ..... 220/521, 220/522, 212, 367.1, 713, 711, 256.1, 254.1; 206/217, 308.1, 307; 40/311; 229/404; 215/229, 230

See application file for complete search history.

(56) References Cited

U.S. PATENT DOCUMENTS

| | | | | |
|---|---|---|---|---|
| RE26,320 | E * | 12/1967 | Miller | 220/374 |
| D243,231 | S | 2/1977 | Smith | |
| 4,586,625 | A * | 5/1986 | Garrett | 220/266 |
| 4,925,051 | A * | 5/1990 | Herbst | 220/713 |
| 5,325,982 | A | 7/1994 | Cobb, Jr. | |
| 5,393,258 | A | 2/1995 | Karterman | |
| 5,529,179 | A * | 6/1996 | Hanson | 206/219 |
| 5,531,347 | A | 7/1996 | Goulding | |
| 5,542,532 | A * | 8/1996 | Mitchell | 206/308.1 |
| 5,713,463 | A | 2/1998 | Lakoski et al. | |
| 5,785,172 | A * | 7/1998 | Bolognia et al. | 206/308.1 |
| 5,829,583 | A * | 11/1998 | VerWeyst et al. | 206/308.1 |
| 5,976,655 | A * | 11/1999 | Sykes | 428/40.1 |
| 5,979,647 | A * | 11/1999 | Han | 206/222 |
| 6,158,155 | A | 12/2000 | Boney | |
| 6,196,411 | B1 * | 3/2001 | Nava et al. | 220/521 |
| 6,311,860 | B1 * | 11/2001 | Reidinger et al. | 220/521 |
| 6,349,821 | B1 | 2/2002 | Gordon et al. | |
| 6,364,102 | B1 * | 4/2002 | Gordon et al. | 206/217 |
| 6,454,087 | B1 | 9/2002 | Gordon et al. | |
| 6,647,696 | B1 * | 11/2003 | Gordon et al. | 53/410 |
| 6,675,960 | B1 * | 1/2004 | Innis | 206/308.1 |
| 2001/0045368 | A1 | 11/2001 | Gordon et al. | |
| 2002/0005365 | A1 | 1/2002 | Gordon et al. | |
| 2002/0020638 | A1 | 2/2002 | Gordon et al. | |
| 2002/0020639 | A1 | 2/2002 | Gordon et al. | |

* cited by examiner

*Primary Examiner*—Robin A. Hylton
(74) *Attorney, Agent, or Firm*—Henricks, Slavin & Holmes LLP

(57) ABSTRACT

Beverage container lid assemblies provide a combined premium display area and cooling/insulating structure for the beverage container.

5 Claims, 19 Drawing Sheets

BEVERAGE CONTAINER LIDS WITH A PREMIUM AND A COMBINED DISPLAY AREA AND COOLING/INSULATING STRUCTURE FOR THE PREMIUM

BACKGROUND OF THE INVENTION

A variety of beverage lid assemblies to which premiums (e.g., digital media disks, CD-ROM business cards, phone cards, coupons, booklets, advertising materials, etc.) can be attached are known. However, known beverage lid assemblies are not optimally suited for use with hot beverage containers (e.g., carry-out cups for coffee or tea). Among other deficiencies, known beverage lid assemblies to which premiums can be attached do not adequately protect the premium from being damaged by heat from a hot beverage product. Thermal protection is important where the premium is sensitive to heat, as in the case of media such as CD-ROM and DataPlay disks. For example, warpage caused by close proximity to heat from a hot beverage product can cause CD-ROMs to spin unevenly in the CD reader thereby rendering them unusable, causing consumers to be upset and manufacturers to incur additional costs. Additionally, media such as DataPlay disks or other cassette-type systems that use a closed compartment are vulnerable to condensation that could damage internal mechanisms. Condensation can occur on a premium when bathed in steam from a hot beverage or when cooled to a temperature lower than the dew point by proximity to an iced beverage. It would be desirable in these situations to have a lid assembly, for a hot or cold beverage, that insulates the premium from the pooling of moisture through condensation.

It would also be desirable to have a lid assembly for a beverage container that prevents the beverage product from splashing out of the container onto either a person or the premium.

It would also be desirable to have a lid assembly for a beverage container that allows the beverage product to be dispensed from the container with the premium still attached to the lid assembly.

It would also be desirable to have a lid assembly for a beverage container that securely holds the premium but also allows the premium to be removed from the lid assembly with a small amount of force, thereby lessening the changes of accidentally removing the lid assembly from the beverage container along with the premium or otherwise unintentionally separating the lid assembly from the beverage container.

BRIEF DESCRIPTION OF THE DRAWINGS

Detailed description of embodiments of the invention will be made with reference to the accompanying drawings.

DETAILED DESCRIPTION

The following is a detailed description of the best presently known mode of carrying out the invention. This description is not to be taken in a limiting sense, but is made merely for the purpose of illustrating the general principles of the invention.

Beverage lid assembly configurations according to the present invention include passages between an upper surface of the lid assembly and a premium that is secured to the lid assembly. The passages allow airflow between the upper surface and the premium and thereby promote cooling and protect the premium from condensation. In some embodiments, the upper surface is inclined which enhances thermal flow. For example, as the hot beverage product warms the upper surface, heated air in the inclined passage between the lid and the premium rises and exits from an upper portion of the passage as cooler air is drawn into a lower portion of the passage.

Figure 1:
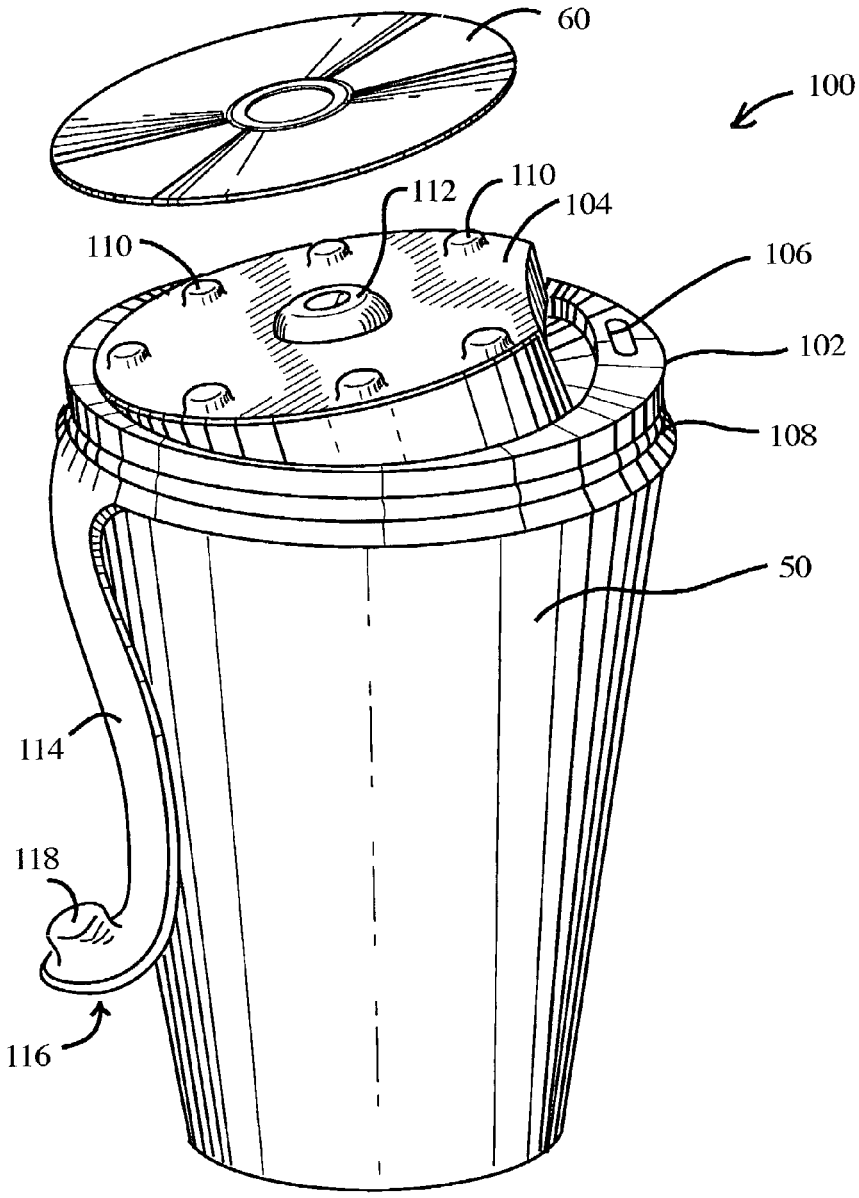
FIG. 1 is a perspective view of a lid assembly for a beverage container according to the present invention which includes an inclined upper surface, elevated risers formed on the upper surface and a clasp member for securing a premium to the elevated risers.

Referring to FIG. 1, an exemplary embodiment of a lid assembly 100 according to the present invention is shown. The lid assembly 100 includes a lid member 102 with an upper surface 104 and a beverage dispensing aperture 106. A rim portion 108 is formed about the upper surface 104 for securing the lid member 102 to a beverage container 50. The upper surface 104 is formed as shown with a plurality of elevated risers or spacer members 110 extending upward. In the exemplary illustrated embodiment, these perimeter spacer members 110 are positioned about the upper surface 104 adjacent the rim portion 108. The spacer members 110, in conjunction with a centrally positioned riser member 112, provide a combined premium display area and cooling/insulating structure that accommodates a premium in the form of a digital media disk 60 (e.g., CD, DVD, etc.). Together, the spacer members 110 and the centrally positioned riser member 112 keep the premium separated from the upper surface 104. This provides a passage which allows airflow between the upper surface 104 and the premium and thereby promotes cooling and protects the premium from condensation. In the exemplary illustrated embodiment, the upper surface 104 is also formed at an angle relative to the bottom edge of the rim portion 108 promoting the flow of air through the passage.

Figure 1A:
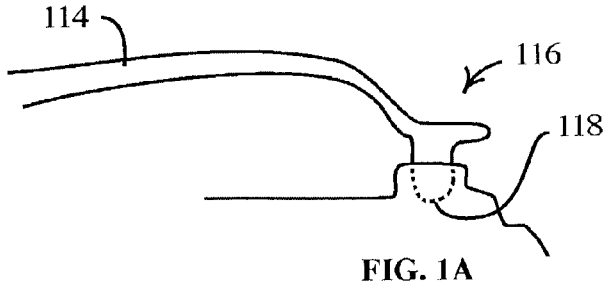
FIG. 1A is a partial cross-sectional side view of the lid assembly for a beverage container of FIG. 1 showing a mouthpiece anti-spill plug of the clasp member inserted into a beverage dispensing aperture of the lid assembly.

The lid assembly 100 also includes a mechanism for securing the premium to the spacer members such that the premium is separated from the upper surface 104 by a gap which allows airflow over the upper surface 104. Generally, the securing mechanism comprises a top part secured to the lid member. For example, the securing mechanism comprises a clasp member for securing a premium to the elevated risers. In the embodiment illustrated in FIGS. 1 and 1A, the securing mechanism comprises an arm member 114 secured to the rim portion 108, the arm member 114 including an end portion 116 with a plug 118 sized to be fitted within the beverage dispensing aperture 106. In its sealed position (FIG. 1A), the mouthpiece anti-spill plug 118 of the clasp member is inserted into the beverage dispensing aperture 118 of the lid assembly 100. By way of example, the holder-plug 118 is a formed extension of the lid or is a part attached to the lid with a holder-plug formed on the end of the extension that may bend over the CD/premium to secure the CD/premium to the lid and that can additionally be positioned to plug into and thereby seal the beverage sipping aperture. It should be appreciated, however, that the securing mechanism of the present invention is not limited to the clasp embodiment illustrated in FIGS. 1 and 1A.

Figure 2B:
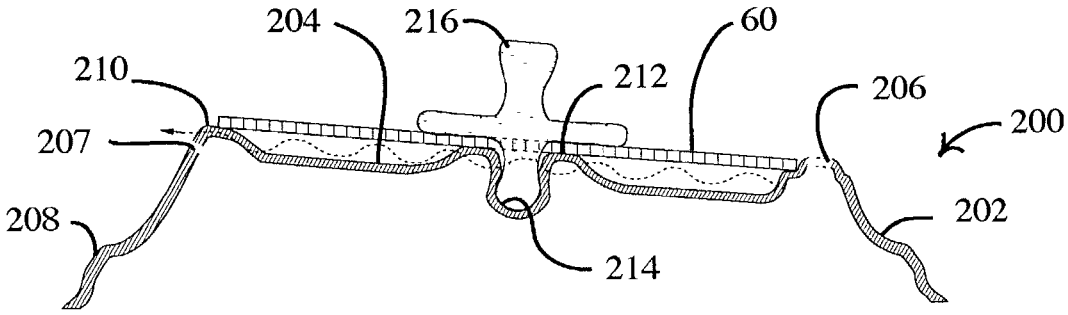
FIGS. 2A and 2B are top and cross-sectional side views, respectively, of an exemplary embodiment of a lid assembly for a beverage container according to the present invention which includes an inclined upper surface and a snap-in plug for securing a premium with a hole to the lid assembly.
Figure 2A:
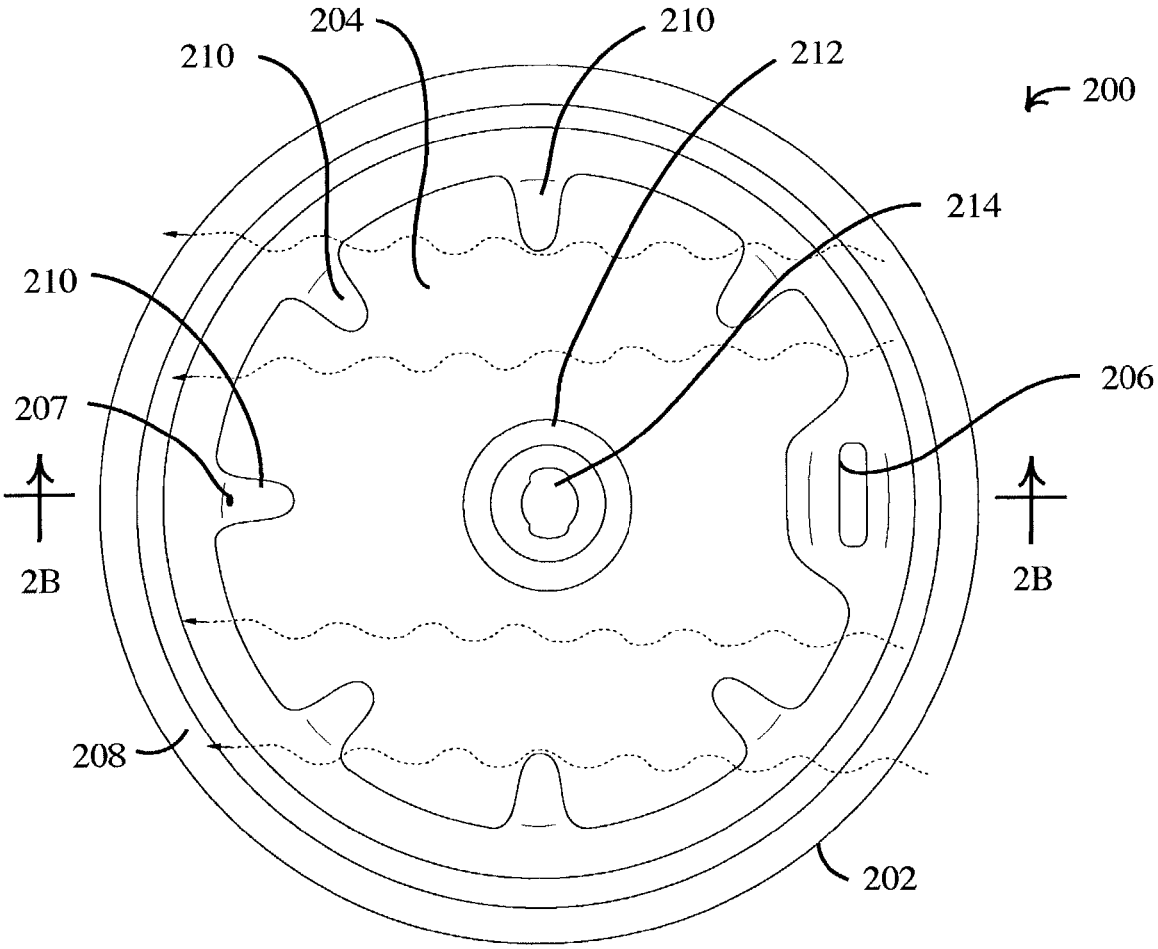

Referring to FIGS. 2A and 2B, a lid assembly 200 includes a lid member 202 with an upper surface 204, a beverage dispensing aperture 206 and a vent 207. A rim portion 208 is formed about the upper surface 204 for securing the lid member 202 to a beverage container. The upper surface 204 is formed as shown with a plurality of elevated risers or spacer members 210 extending upward. In the exemplary illustrated embodiment, these perimeter spacer members 210 are positioned about the upper surface 204 adjacent the rim portion 208. The spacer members 210, in conjunction with a centrally positioned riser member 212, provide a combined premium display area and cooling/insulating structure that accommodates a premium in the form of a digital media disk 60 (FIG. 2B). Together, the spacer members 210 and the centrally positioned riser member 212 keep the premium separated from the upper surface 204. This provides a passage which allows airflow between the upper surface 204 and the premium and thereby promotes cooling and protects the premium from condensation. In the exemplary illustrated embodiment, the upper surface 204 is also formed at an angle relative to the bottom edge of the rim portion 208 promoting the flow of air through the passage.

The lid assembly 200 also includes a mechanism for securing the premium to the spacer members 210. In the exemplary illustrated embodiment, the centrally positioned riser member 212 is formed with a recess 214 for mechanical coupling to a securing mechanism such as a snap-in plug 216. Thus, the exemplary illustrated embodiment accommodates a premium with a centrally located hole with the centrally positioned riser member 212 being sized to receive and mechanically engage the snap fitting plug member 216 by means of a friction fit. Alternatively, the holder-plug can be formed to be fastened to the bottom part of the lid member 202 by means such as an adhesive contact, hook and loop-type fasteners (e.g., VELCRO®), complementary threaded pieces, or other configurations of interlocking parts thereby securing the premium to the bottom part. In one embodiment, the snap fitting plug member 216 and the beverage dispensing aperture 206 are sized such that the lower part of the plug member 216 can be fitted within the beverage dispensing aperture 206 thereby allowing the snap fitting plug member 216 to additionally function as a "sip plug".

Figure 3B:
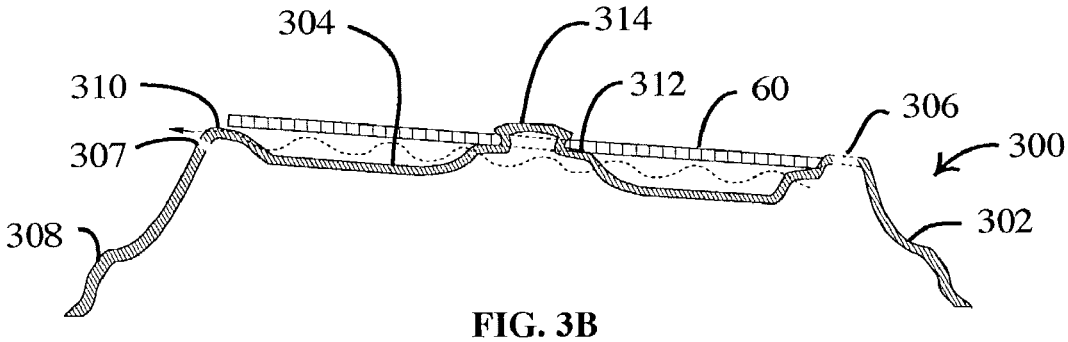
FIGS. 3A and 3B are top and cross-sectional side views, respectively, of an exemplary embodiment of a lid assembly for a beverage container according to the present invention which includes an inclined upper surface and an upwardly protruding snap-on fitting for securing a premium with a hole to the lid assembly.
Figure 3A:
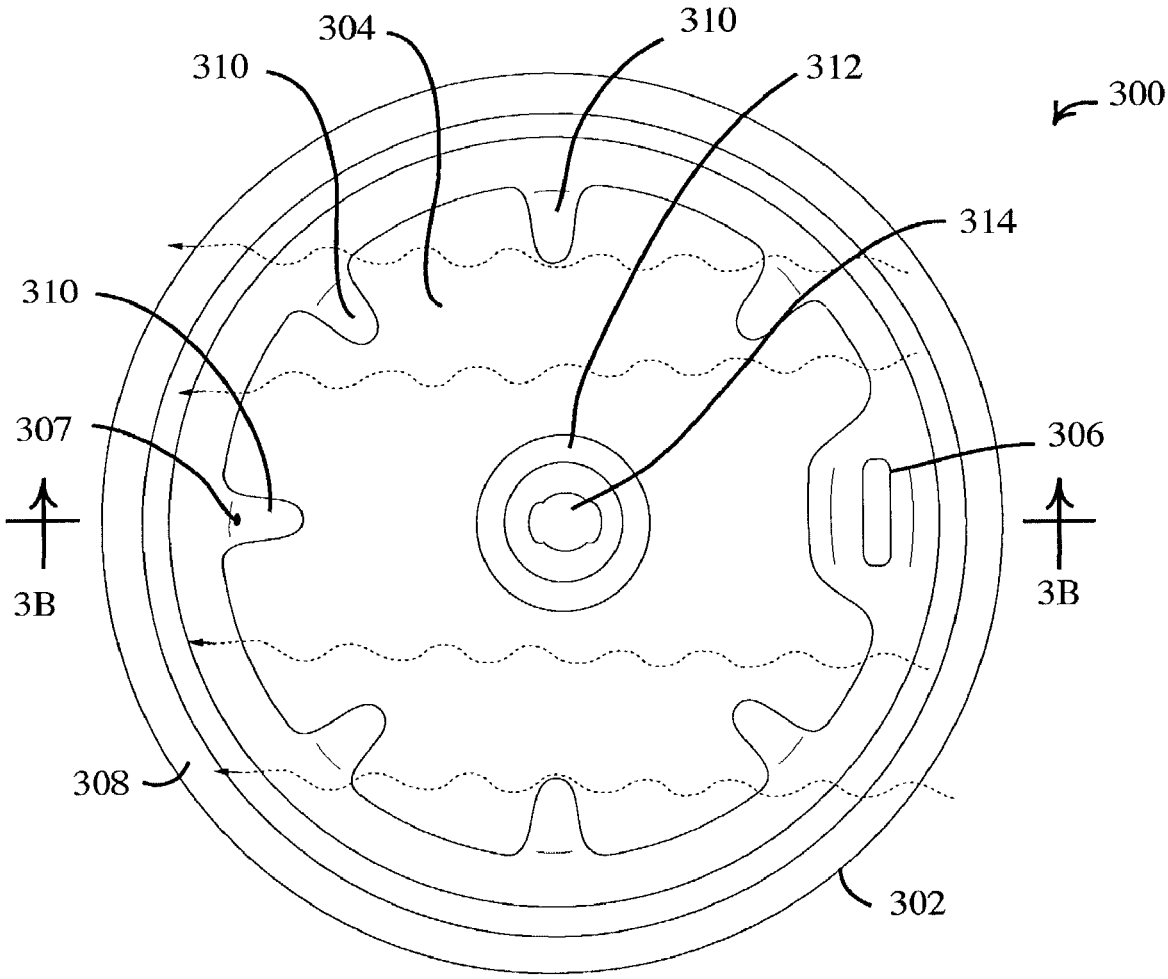

Referring to FIGS. 3A and 3B, a lid assembly 300 includes a lid member 302 with an upper surface 304, a beverage dispensing aperture 306 and a vent 307. A rim portion 308 is formed about the upper surface 304 for securing the lid member 302 to a beverage container. The upper surface 304 is formed as shown with a plurality of elevated risers or spacer members 310 extending upward. In the exemplary illustrated embodiment, these perimeter spacer members 310 are positioned about the upper surface 304 adjacent the rim portion 308. The spacer members 310, in conjunction with a centrally positioned riser member 312, provide a combined premium display area and cooling/insulating structure that accommodates a premium in the form of a digital media disk 60 (FIG. 3B). Together, the spacer members 310 and the centrally positioned riser member 312 keep the premium separated from the upper surface 304. This provides a passage which allows airflow between the upper surface 304 and the premium and thereby promotes cooling and protects the premium from condensation. In the exemplary illustrated embodiment, the upper surface 304 is also formed at an angle relative to the bottom edge of the rim portion 308 promoting the flow of air through the passage.

The lid assembly 300 also includes a mechanism for securing the premium to the spacer members 310. In the exemplary illustrated embodiment, the centrally positioned riser member 312 is formed with an upwardly protruding snap-on fitting 314 for securing a premium with a hole to the lid assembly. Thus, the exemplary illustrated embodiment accommodates a premium with a centrally located hole with the snap-on fitting member 314 being formed and sized to fit through the centrally located hole and snap together with the premium while maintaining the gap between the premium and the upper surface.

Figure 4B:
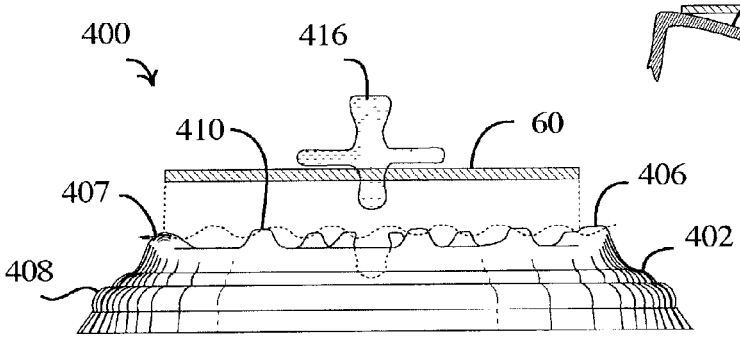
FIGS. 4A and 4B are top and side views, respectively, of an exemplary embodiment of a lid assembly for a beverage container according to the present invention which includes a level upper surface, spacers and a snap-in plug for securing a premium with a hole to the lid assembly.
Figure 4C:
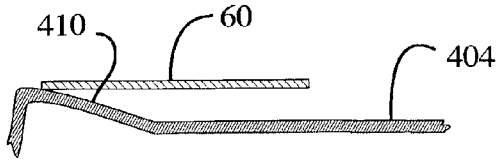
FIGS. 4C and 4D are partial cross-sectional side views of the lid assembly for a beverage container of FIG. 4A.
Figure 4D:
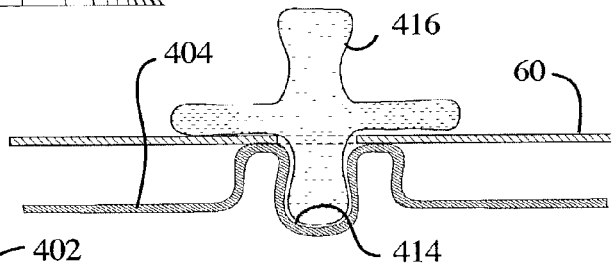
Figure 4A:
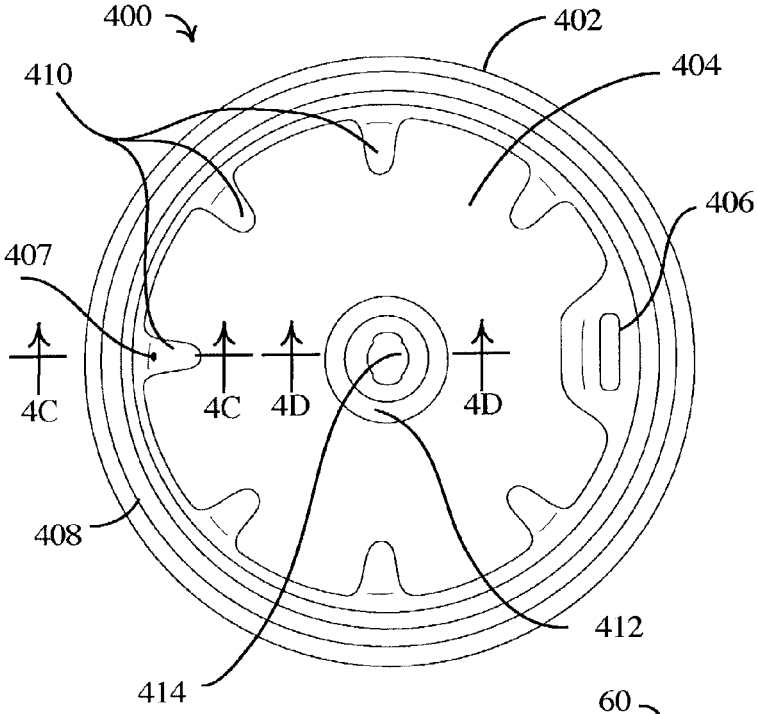
Figure 4E:
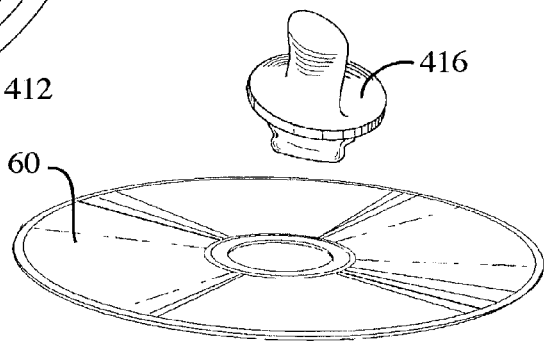
FIG. 4E is a perspective view of an exemplary disk premium and the holder/sip plug of the lid assembly for a beverage container of FIG. 4A.

Referring to FIGS. 4A–4E, a lid assembly 400 includes a lid member 402 with a level upper surface 404, a beverage dispensing aperture 406 and a vent 407. A rim portion 408 is formed about the upper surface 404 for securing the lid member 402 to a beverage container. The upper surface 404 is formed as shown with a plurality of elevated risers or spacer members 410 extending upward. In the exemplary illustrated embodiment, these perimeter spacer members 410 are positioned about the upper surface 404 adjacent the rim portion 408. The spacer members 410, in conjunction with a centrally positioned riser member 412, provide a combined premium display area and cooling/insulating structure that accommodates a premium in the form of a digital media disk 60 (FIGS. 4B–4D). Together, the spacer members 410 and the centrally positioned riser member 412 keep the premium separated from the upper surface 404. This provides a passage which allows airflow between the upper surface 404 and the premium and thereby promotes cooling and protects the premium from condensation.

The lid assembly 400 also includes a mechanism for securing the premium to the spacer members 410. In the exemplary illustrated embodiment, the centrally positioned riser member 412 is formed with a recess 414 for mechanical coupling to a securing mechanism such as a snap-in plug 416. Thus, the exemplary illustrated embodiment accommodates a premium with a centrally located hole with the centrally positioned riser member 412 being sized to receive and mechanically engage the snap fitting plug member 416 by means of a friction fit. Alternatively, the holder-plug can be formed to be fastened to the bottom part of the lid member 402 by means such as an adhesive contact, hook and loop-type fasteners (e.g., VELCRO®), complementary threaded pieces, or other configurations of interlocking parts thereby securing the premium to the bottom part. In one embodiment, the snap fitting plug member 416 and the beverage dispensing aperture 406 are sized such that the lower part of the plug member 416 can be fitted within the beverage dispensing aperture 406 thereby allowing the snap fitting plug member 416 to additionally function as a "sip plug".

Figure 5B:
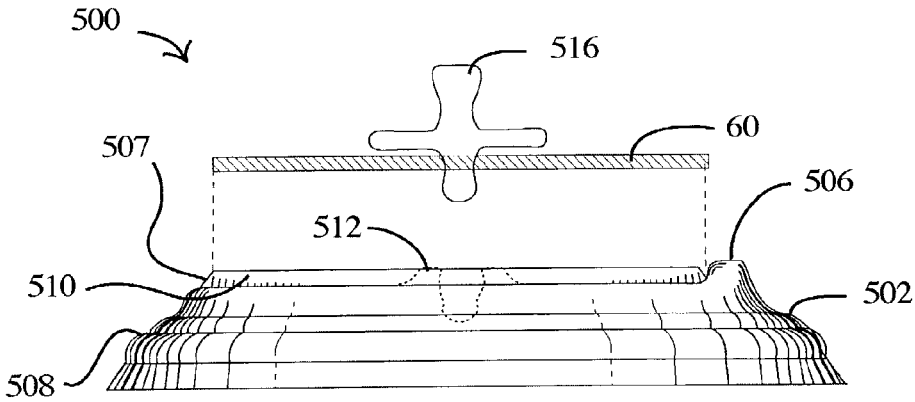
FIGS. 5A and 5B are top and side views, respectively, of an exemplary embodiment of a lid assembly for a beverage container according to the present invention which includes a level upper surface, ribbed spacers and a snap-in plug for securing a premium with a hole to the lid assembly.
Figure 5C:
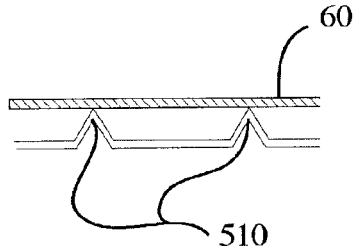
FIG. 5C is a partial cross-sectional view across an exemplary disk premium and two of the ribbed spacers of the lid assembly for a beverage container of FIG. 5A.
Figure 5A:
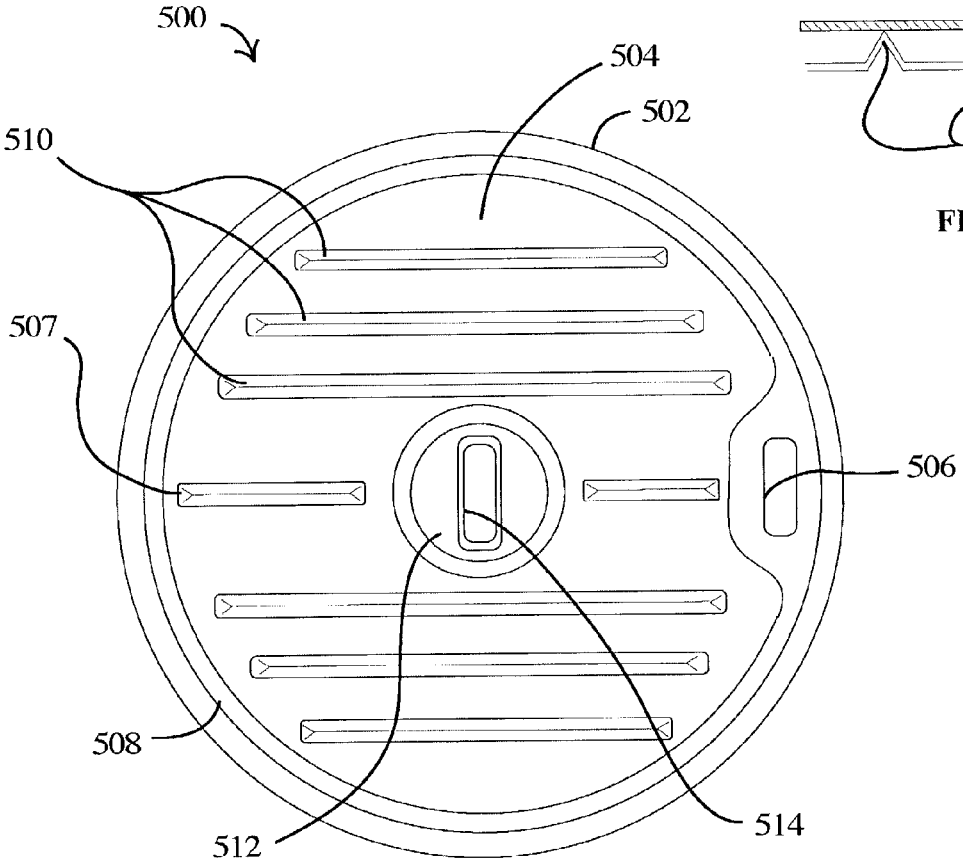

Referring to FIGS. 5A–5C, a lid assembly 500 includes a lid member 502 with a level upper surface 504, a beverage dispensing aperture 506 and a vent 507. A rim portion 508 is formed about the upper surface 504 for securing the lid member 502 to a beverage container. The upper surface 504 is formed as shown with a plurality of ribbed spacer members 510 that extend upward to provide channels which allow airflow over the upper surface 504. In the exemplary illustrated embodiment, the ribbed spacer members 510 run (in parallel as shown) across the upper surface 504 beginning on a side of the lid member adjacent the beverage dispensing aperture 506 and ending on an opposite side adjacent the vent 507. The ribbed spacer members 510, in conjunction with a centrally positioned riser member 512, provide a combined premium display area and cooling/insulating structure that accommodates a premium in the form of a digital media disk 60 (FIG. 5B). Together, the ribbed spacer members 510 and the centrally positioned riser member 512 keep the premium separated from the upper surface 504. This provides a passage which allows airflow between the upper surface 504 and the premium and thereby promotes cooling and protects the premium from condensation.

The lid assembly 500 also includes a mechanism for securing the premium to the ribbed spacer members 510. In the exemplary illustrated embodiment, the centrally positioned riser member 512 is formed with a recess 514 for mechanical coupling to a securing mechanism such as a snap-in plug 516. Thus, the exemplary illustrated embodiment accommodates a premium with a centrally located hole with the centrally positioned riser member 512 being sized to receive and mechanically engage the snap fitting plug member 516 by means of a friction fit. Alternatively, the holder-plug can be formed to be fastened to the bottom part of the lid member 502 by means such as an adhesive contact, hook and loop-type fasteners (e.g., VELCRO®), complementary threaded pieces, or other configurations of interlocking parts thereby securing the premium to the bottom part. In one embodiment, the snap fitting plug member 516 and the beverage dispensing aperture 506 are sized such that the lower part of the plug member 516 can be fitted within the beverage dispensing aperture 506 thereby allowing the snap fitting plug member 516 to additionally function as a "sip plug".

Figure 6B:
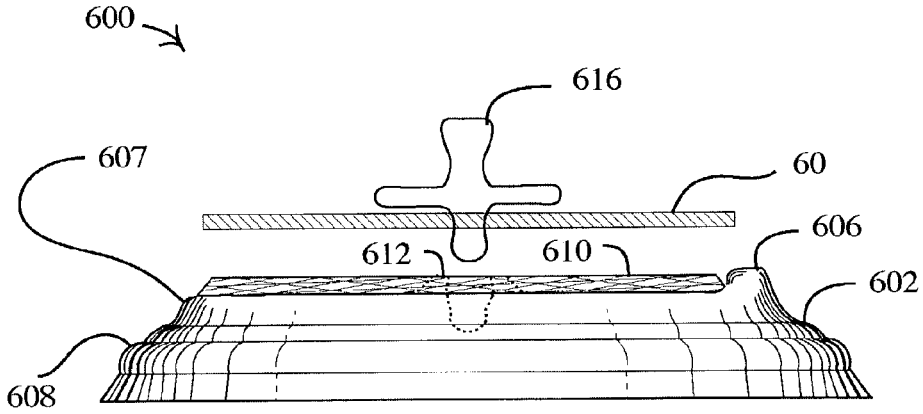
FIGS. 6A and 6B are top and side views, respectively, of an exemplary embodiment of a lid assembly for a beverage container according to the present invention which includes a level upper surface, a fibrous spacer and a snap-in plug for securing a premium with a hole to the lid assembly.
Figure 6C:
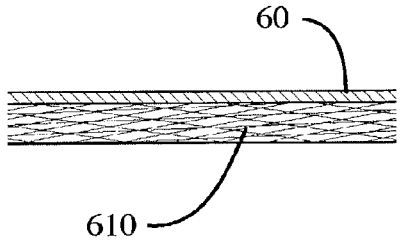
FIG. 6C is a partial cross-sectional view across an exemplary disk premium and the fibrous spacer of the lid assembly for a beverage container of FIG. 6A.
Figure 6A:
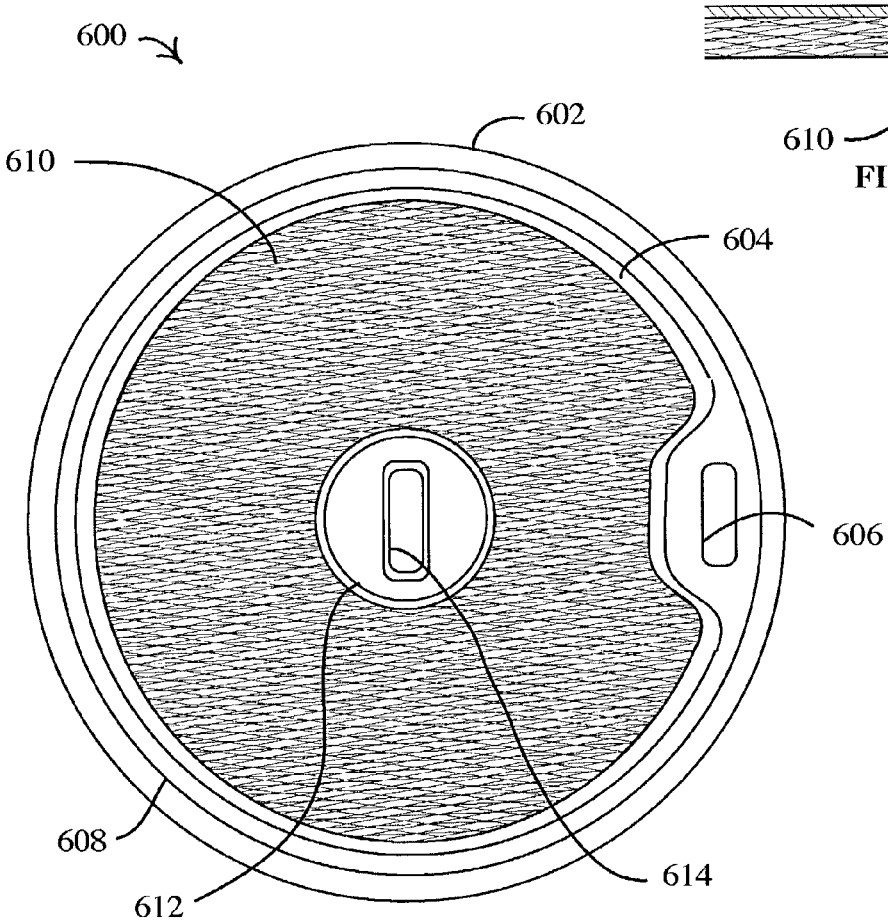

Referring to FIGS. 6A–6C, a lid assembly 600 includes a lid member 602 with a level upper surface 604, a beverage dispensing aperture 606 and a vent 607. A rim portion 608 is formed about the upper surface 604 for securing the lid member 602 to a beverage container. A spacer member 610 of the lid assembly is formed such that it provides channels which allow airflow over the upper surface 604. In the exemplary illustrated embodiment, the spacer member 610 comprises a piece of fibrous material sized to fit over the upper surface, the fibrous spacer member providing a combined premium display area and cooling/insulating structure that accommodates a premium in the form of a digital media disk 60 (FIGS. 6B and 6C). The fibrous spacer member keeps the premium separated from the upper surface 604. This provides a passage which allows airflow between the upper surface 604 and the premium and thereby promotes cooling and protects the premium from condensation. Alternatively, the spacer member 610 can comprise a corrugated spacer member formed, for example, from a sheet of corrugated cardboard (such as in FIG. 16) cut to fit over the upper surface. Furthermore, it should be appreciated that the spacer member 610 can comprise multiple pieces instead of one, or multiple layers.

The lid assembly 600 also includes a mechanism for securing the premium to the spacer member 610. In the exemplary illustrated embodiment, the centrally positioned riser member 612 is formed with a recess 614 for mechanical coupling to a securing mechanism such as a snap-in plug 616. Thus, the exemplary illustrated embodiment accommodates a premium with a centrally located hole with the centrally positioned riser member 612 being sized to receive and mechanically engage the snap fitting plug member 616 by means of a friction fit. Alternatively, the holder-plug can be formed to be fastened to the bottom part of the lid member 602 by means such as an adhesive contact, hook and loop-type fasteners (e.g., VELCRO®), complementary threaded pieces, or other configurations of interlocking parts thereby securing the premium to the bottom part. In one embodiment, the snap fitting plug member 616 and the beverage dispensing aperture 606 are sized such that the lower part of the plug member 616 can be fitted within the beverage dispensing aperture 606 thereby allowing the snap fitting plug member 616 to additionally function as a "sip plug".

Figure 7:
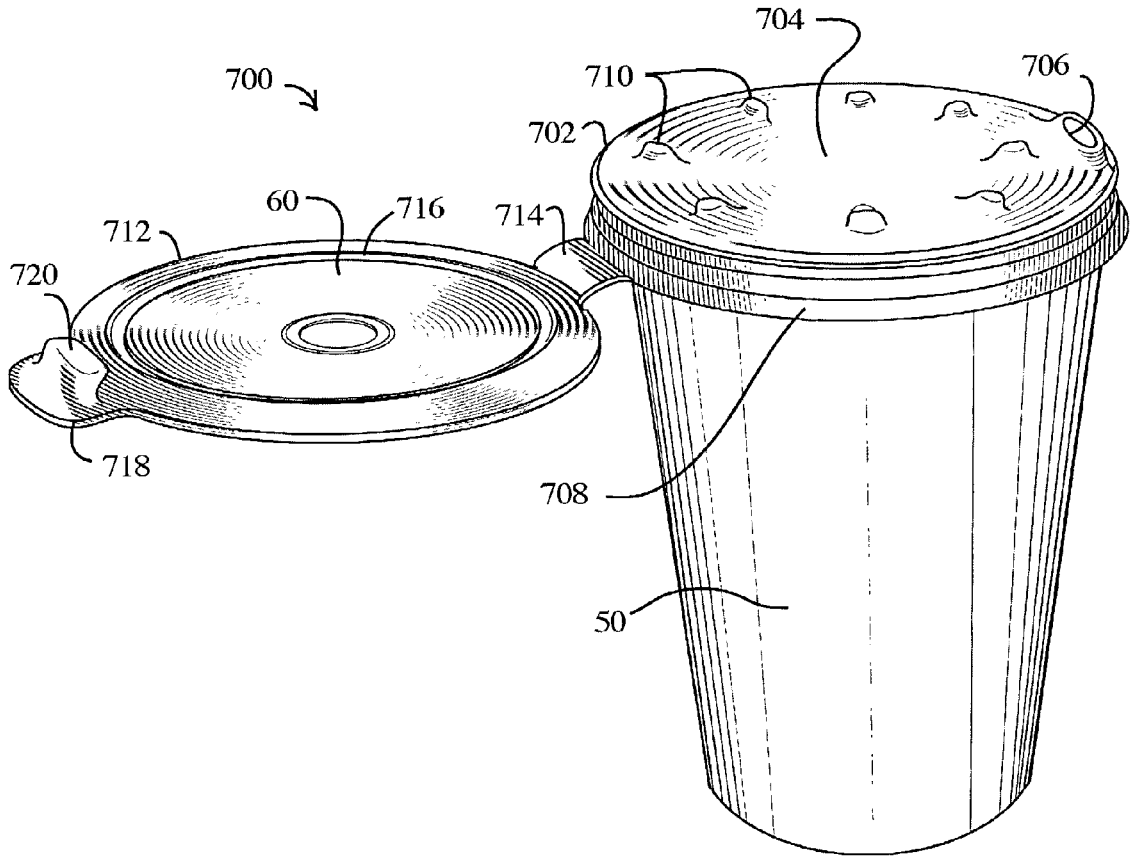
FIG. 7 is a perspective view of an exemplary embodiment of a lid assembly for a beverage container according to the present invention which includes a level upper surface, spacers, a fold-over lid (top part) configured to hold a disk-shaped premium and formed with a mouthpiece anti-spill plug.

Referring to FIG. 7, a lid assembly 700 includes a lid member 702 with a level upper surface 704 and a beverage dispensing aperture 706. A rim portion 708 is formed about the upper surface 704 for securing the lid member 702 to a beverage container 50. The upper surface 704 is formed as shown with a plurality of elevated risers or spacer members 710 extending upward. In the exemplary illustrated embodiment, these perimeter spacer members 710 are positioned about the upper surface 704 adjacent the rim portion 708. The spacer members 710 provide a combined premium display area and cooling/insulating structure that accommodates a premium in the form of a digital media disk 60. The spacer members 710 keep the premium separated from the upper surface 704. This provides a passage which allows airflow between the upper surface 704 and the premium and thereby promotes cooling and protects the premium from condensation.

The lid assembly 700 also includes a mechanism for securing the premium to the spacer members such that the premium is separated from the upper surface 704 by a gap which allows airflow over the upper surface 704. Generally, the securing mechanism comprises a top part 712 secured to the lid member 702. For example, the top part 712 is secured to the rim portion 708 with a hinge mechanism 714. In the exemplary illustrated embodiment, the bottom part 702 and the top part 712 are mechanically interconnected with a flexible hinge member 714 that is (integrally) formed therebetween as shown. In the exemplary illustrated embodiment, the top part 712 includes a recessed portion 716 sized to fit over and receive a disk-shaped premium as well as an end portion 718 with a plug 720 sized to be fitted within the beverage dispensing aperture 706. By way of example, the holder-plug 720 is a protrusion molded such that when the top part 712 is fitted to the bottom part 702 it serves to secure the premium to the bottom part 702 and additionally plugs into and thereby seals the beverage dispensing aperture 706.

Figure 8:
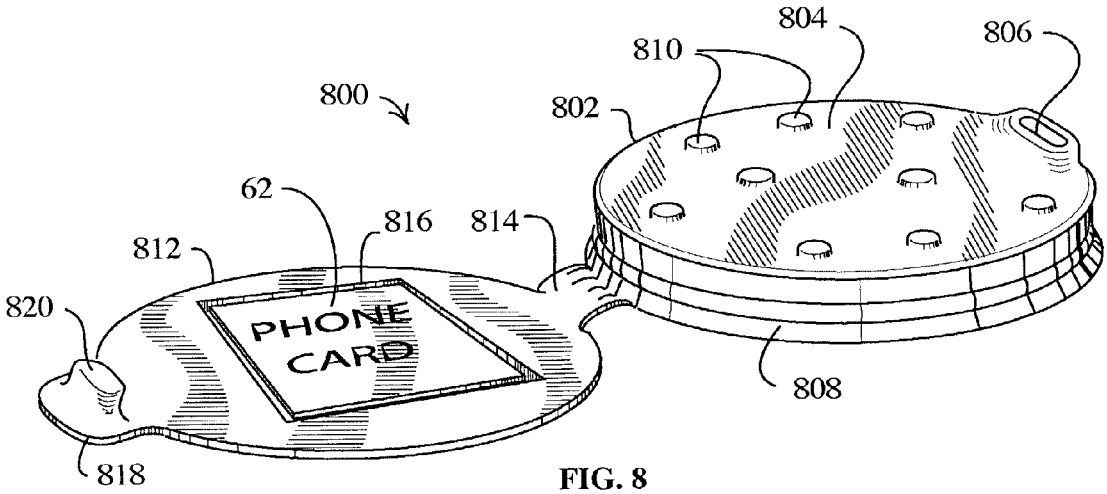
FIG. 8 is a perspective view of an exemplary embodiment of a lid assembly for a beverage container according to the present invention which includes a level upper surface, spacers, a fold-over lid (top part) configured to hold a card-shaped premium and formed with a mouthpiece anti-spill plug.

Various embodiments of lid assemblies according to the present invention are configured to accommodate items other than disk-shaped premiums. By way of example, and referring to FIG. 8, a lid assembly 800 includes a lid member 802 with a level upper surface 804 and a beverage dispensing aperture 806. A rim portion 808 is formed about the upper surface 804 for securing the lid member 802 to a beverage container. In the exemplary illustrated embodiment, the upper surface 804 is formed with a plurality of elevated risers or spacer members 810 extending upward and positioned about the upper surface 804 as shown. The spacer members 810 provide a combined premium display area and cooling/insulating structure that accommodates a premium in the form of a card-shaped object 62 such as a telephone card. The spacer members 810 keep the premium separated from the upper surface 804. This provides a passage which allows airflow between the upper surface 804 and the premium and thereby promotes cooling and protects the premium from condensation.

The lid assembly 800 also includes a mechanism for securing the premium to the spacer members such that the premium is separated from the upper surface 804 by a gap which allows airflow over the upper surface 804. Generally, the securing mechanism comprises a top part 812 secured to the lid member 802. For example, the top part 812 is secured to the rim portion 808 with a hinge mechanism 814. In the exemplary illustrated embodiment, the bottom part 802 and the top part 812 are mechanically interconnected with a flexible hinge member 814 that is (integrally) formed therebetween as shown. In the exemplary illustrated embodiment, the top part 812 includes a recessed portion 816 sized to fit over and receive a card-shaped premium as well as an end portion 818 with a plug 820 sized to be fitted within the beverage dispensing aperture 806. By way of example, the holder-plug 820 is a protrusion molded such that when the top part 812 is fitted to the bottom part 802 it serves to secure the premium to the bottom part 802 and additionally plugs into and thereby seals the beverage dispensing aperture 806.

Figure 9:
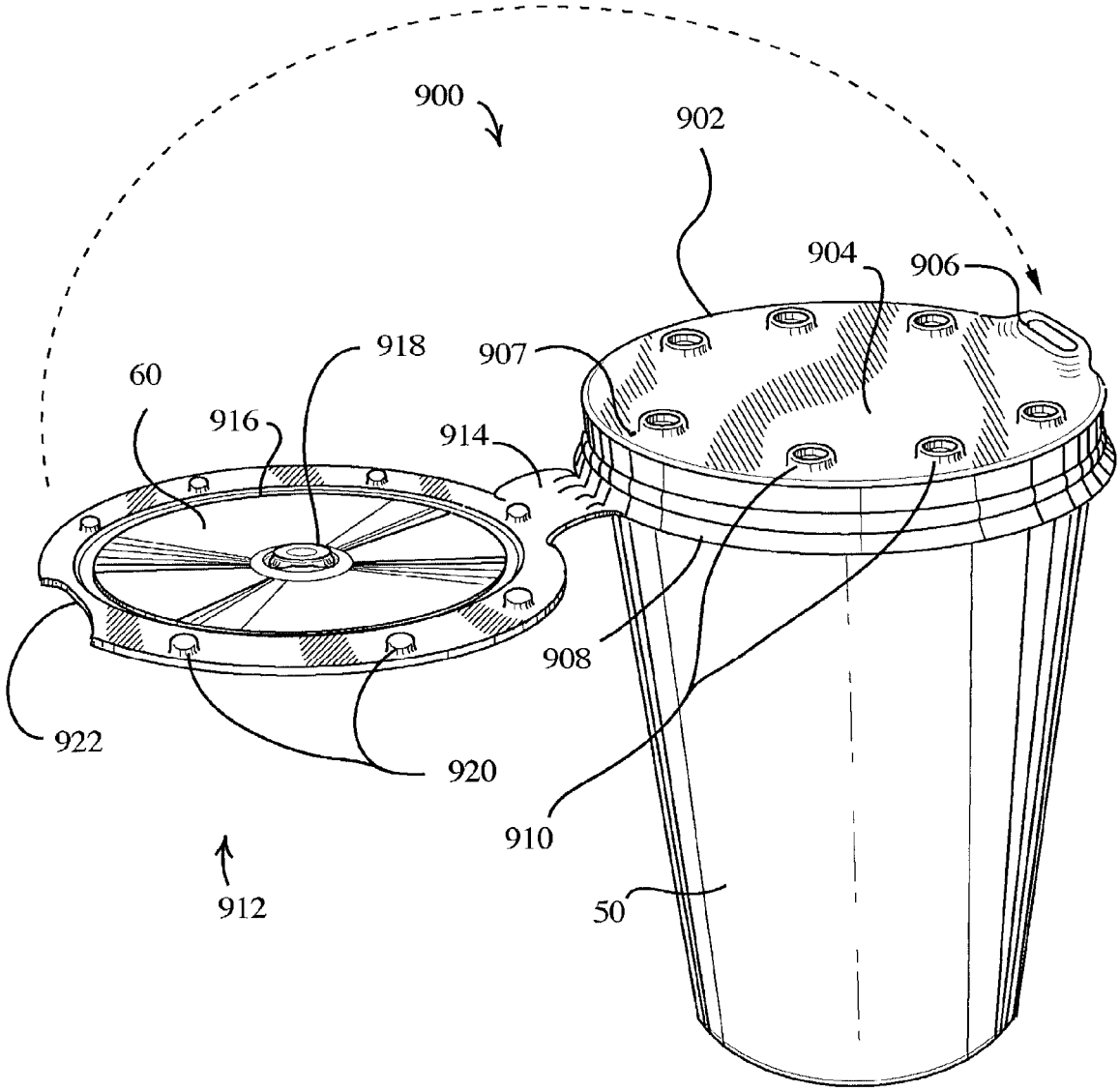
FIG. 9 is a perspective view of an exemplary embodiment of a lid assembly for a beverage container according to the present invention which includes a level upper surface, spacers and a fold-over lid (top part) configured to hold a disk-shaped premium and with downwardly extending protrusions for interlocking with the spacers, a cutout to accommodate a mouthpiece of the lid assembly and a protruding clasp member for mechanically engaging the disk-shaped premium.

Referring to FIG. 9, a lid assembly 900 includes a lid member 902 with a level upper surface 904, a beverage dispensing aperture 906 and a vent 907. A rim portion 908 is formed about the upper surface 904 for securing the lid member 902 to a beverage container 50. The upper surface 904 is formed as shown with a plurality of elevated risers or spacer members 910 extending upward. In the exemplary illustrated embodiment, these perimeter spacer members 910 are positioned about the upper surface 904 adjacent the rim portion 908.

The lid assembly 900 also includes a top part 912 which is secured to the rim portion 908 with a hinge mechanism 914. In the exemplary illustrated embodiment, the bottom part 902 and the top part 912 are mechanically interconnected with a flexible hinge member 914 that is (integrally) formed therebetween as shown. In the exemplary illustrated embodiment, the top part 912 includes a recessed portion 916 sized to fit over and receive a disk-shaped premium 60. The exemplary illustrated top part 912 is also formed with a protruding clasp member 918 configured for mechanically coupling the disk-shaped premium to the top part 912 and with downwardly extending protrusions 920 that are shaped complementary to the spacer members 910 for interlocking with the spacer members. The protruding clasp member 918 functions as a mechanism for securing the premium to the top part 912 such that, when the top part 912 is in its closed position with the spacer members 910 and the protrusions 920 interlocked, the premium is separated from the upper surface 904 by a gap which allows airflow over the upper surface 904. Thus, the spacer members 910, recessed portion 916, protruding clasp member 918 and protrusions 920 provide a combined premium display area and cooling/insulating structure and keep the premium separated from the upper surface 904. This provides a passage which allows airflow between the upper surface 904 and the premium and thereby promotes cooling and protects the premium from condensation. The top part 912 can be formed from an opaque material or from a transparent or translucent material so that the premium will be visible when the top part is in its closed position, thereby allowing the consumer to see, for example, a message, instruction, logo, "peel and win" sticker or other visible indicia on the premium. The exemplary illustrated top part 912 further includes a cutout 922 to accommodate the beverage dispensing aperture 906 (mouthpiece) of the lid assembly.

Figure 10:
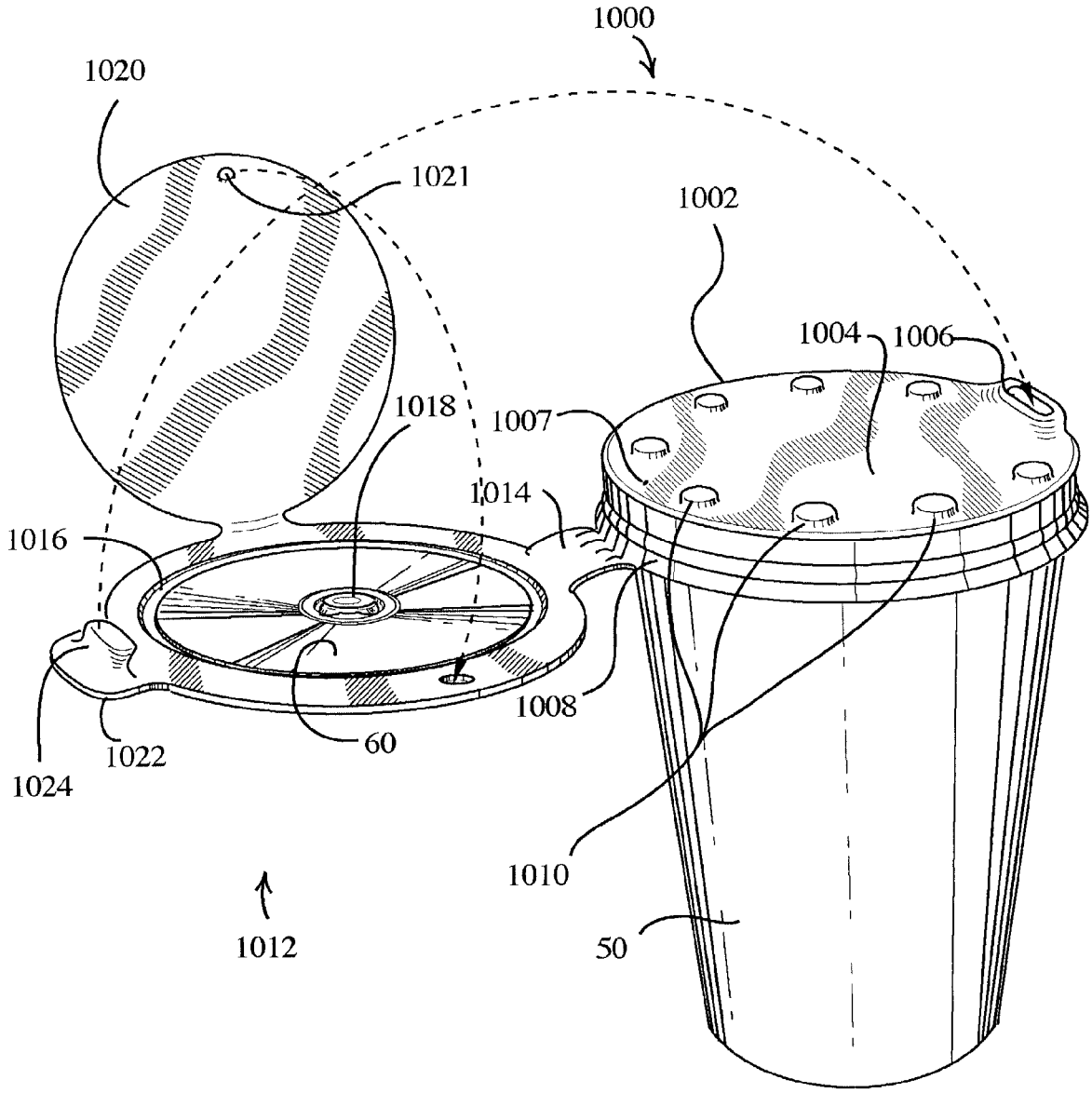
FIG. 10 is a perspective view of an exemplary embodiment of a lid assembly for a beverage container according to the present invention which includes a level upper surface, spacers and a fold-over lid (top part) configured to hold a disk-shaped premium and with a protruding clasp member for mechanically engaging the disk-shaped premium, a hinged cover for protecting the premium and a mouthpiece anti-spill plug.

Referring to FIG. 10, a lid assembly 1000 includes a lid member 1002 with a level upper surface 1004, a beverage dispensing aperture 1006 and a vent 1007. A rim portion 1008 is formed about the upper surface 1004 for securing the lid member 1002 to a beverage container 50. The upper surface 1004 is formed as shown with a plurality of elevated risers or spacer members 1010 extending upward. In the exemplary illustrated embodiment, these perimeter spacer members 1010 are positioned about the upper surface 1004 adjacent the rim portion 1008.

The lid assembly 1000 also includes a top part 1012 which is secured to the rim portion 1008 with a hinge mechanism 1014. In the exemplary illustrated embodiment, the bottom part 1002 and the top part 1012 are mechanically interconnected with a flexible hinge member 1014 that is (integrally) formed therebetween as shown. In the exemplary illustrated embodiment, the top part 1012 includes a recessed portion 1016 sized to fit over and receive a disk-shaped premium 60. The exemplary illustrated top part 1012 is also formed with a protruding clasp member 1018 configured for mechanically coupling the disk-shaped premium to the top part 1012, a hinged cover 1020 with a clasp 1021 for securing the premium within the recessed portion, and an end portion 1022 with a plug 1024 sized to be fitted within the beverage dispensing aperture 1006. The protruding clasp member 1018 functions as a mechanism for securing the premium to the top part 1012; and the hinged cover 1020, in its closed position (i.e., with the cover clasp 1021 fitted into its complementary recess in the top part 1012), provides additional protection for the premium. The protruding clasp member 1018 and the hinged cover 1020 keep the premium separated from the upper surface 1004 by a gap which allows airflow over the upper surface 1004. Thus, the spacer members 1010, recessed portion 1016, protruding clasp member 1018 and hinged cover 1020 provide a combined premium display area and cooling/insulating structure and keep the premium separated from the upper surface 1004. This provides a passage which allows airflow between the upper surface 1004 and the premium and thereby promotes cooling and protects the premium from condensation. The top part 1012 and/or the hinged cover 1020 can be formed from an opaque material or from a transparent or translucent material so that the premium will be visible when the top part is in its closed position, thereby allowing the consumer to see, for example, a message, instruction, logo, "peel and win" sticker or other visible indicia on the premium. By way of example, the holder-plug 1024 is a protrusion molded such that when the top part 1012 is fitted to the bottom part 1002 it serves to secure the premium to the bottom part 1002 and additionally plugs into and thereby seals the beverage dispensing aperture 1006. Additionally, it should be appreciated that in any of the lid assembly embodiments disclosed herein the hinges can be eliminated and/or alternative securing mechanisms can be employed.

Figure 11A:
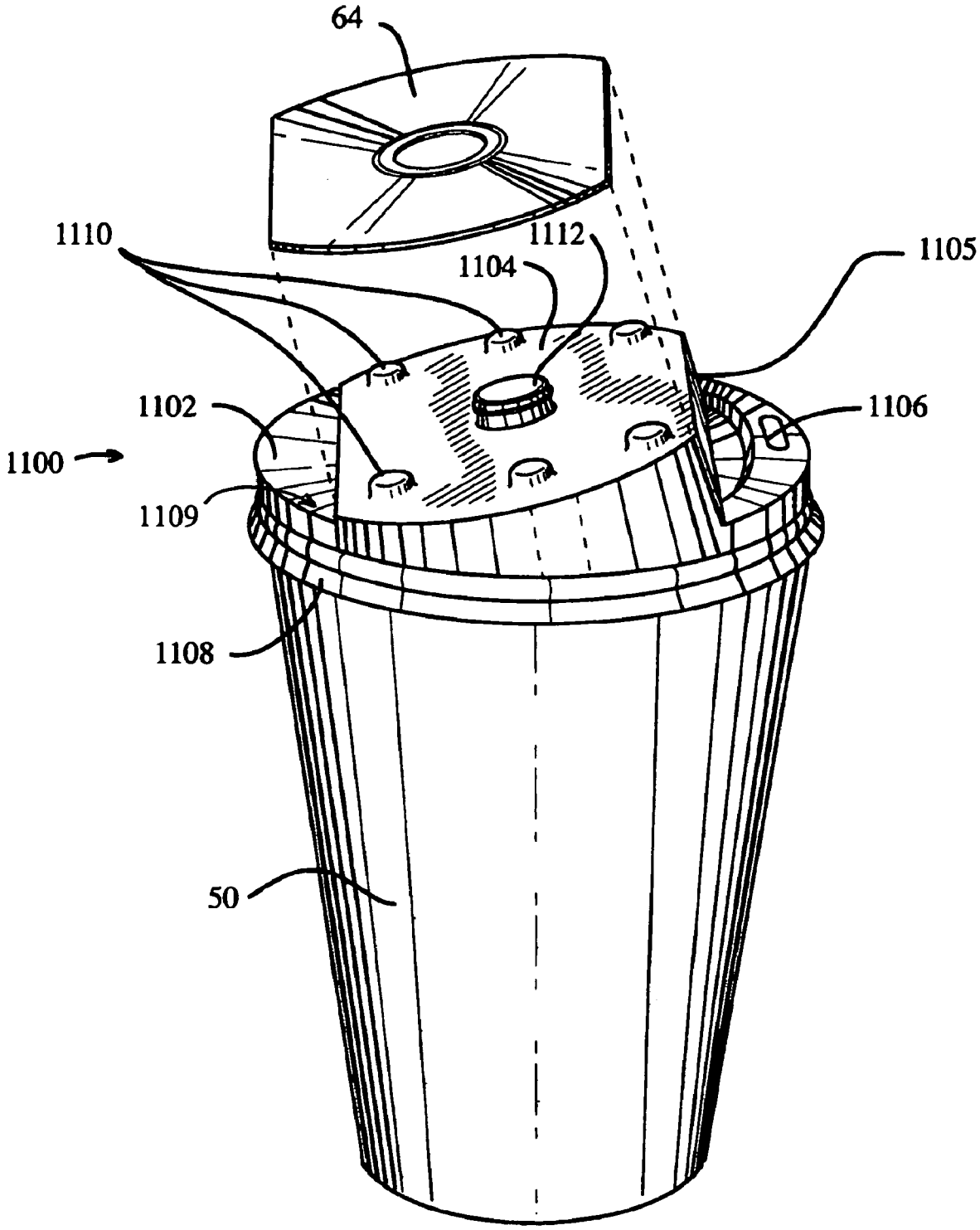
FIG. 11A is a perspective view of an exemplary embodiment of a lid assembly for a beverage container according to the present invention which includes an inclined upper surface with an elevated edge facing a beverage dispensing aperture of the lid assembly, the upper surface being formed with risers and an upwardly protruding snap-on fitting for securing a complementary shaped premium with a hole to the lid assembly.

Referring to FIG. 11A, a lid assembly 1100 includes a lid member 1102 with an inclined upper surface 1104 and an elevated edge 1105 facing a beverage dispensing aperture 1106 of the lid assembly. A rim portion 1108 is formed about the upper surface 1104 for securing the lid member 1102 to a beverage container. The upper surface 1104 is formed as shown with a plurality of elevated risers or spacer members 1110 and an upwardly protruding snap-on fitting 1112 for securing a premium (with a hole that is sized and shaped complementary to the snap-on fitting) to the lid assembly. In the exemplary illustrated embodiment, the upper surface 1104 is at an angle relative to a plane containing a bottom edge of the rim portion 1108 with an apex 1109 of the angle being located near a portion of the lid member 1102 opposite from the beverage dispensing aperture 1106. Also, a perimeter of the upper surface 1104 is complementary in shape to the premium (e.g., a standard 3" CD-ROM business card 64, as shown). In the exemplary illustrated embodiment, the perimeter spacer members 1110 are positioned as shown about the upper surface 1104 adjacent the perimeter. The spacer members 1110, in conjunction with the upwardly protruding snap-on fitting 1112, provide a combined premium display area and cooling/insulating structure that accommodates the premium. Together, the spacer members 1110 and the upwardly protruding snap-on fitting 1112 keep the premium separated from the upper surface 1104. This provides a passage which allows airflow between the upper surface 1104 and the premium and thereby promotes cooling and protects the premium from condensation. The angle of the upper surface 1104 relative to the plane containing the bottom edge of the rim portion 1108 promotes the flow of air through the passage.

Figure 11B:
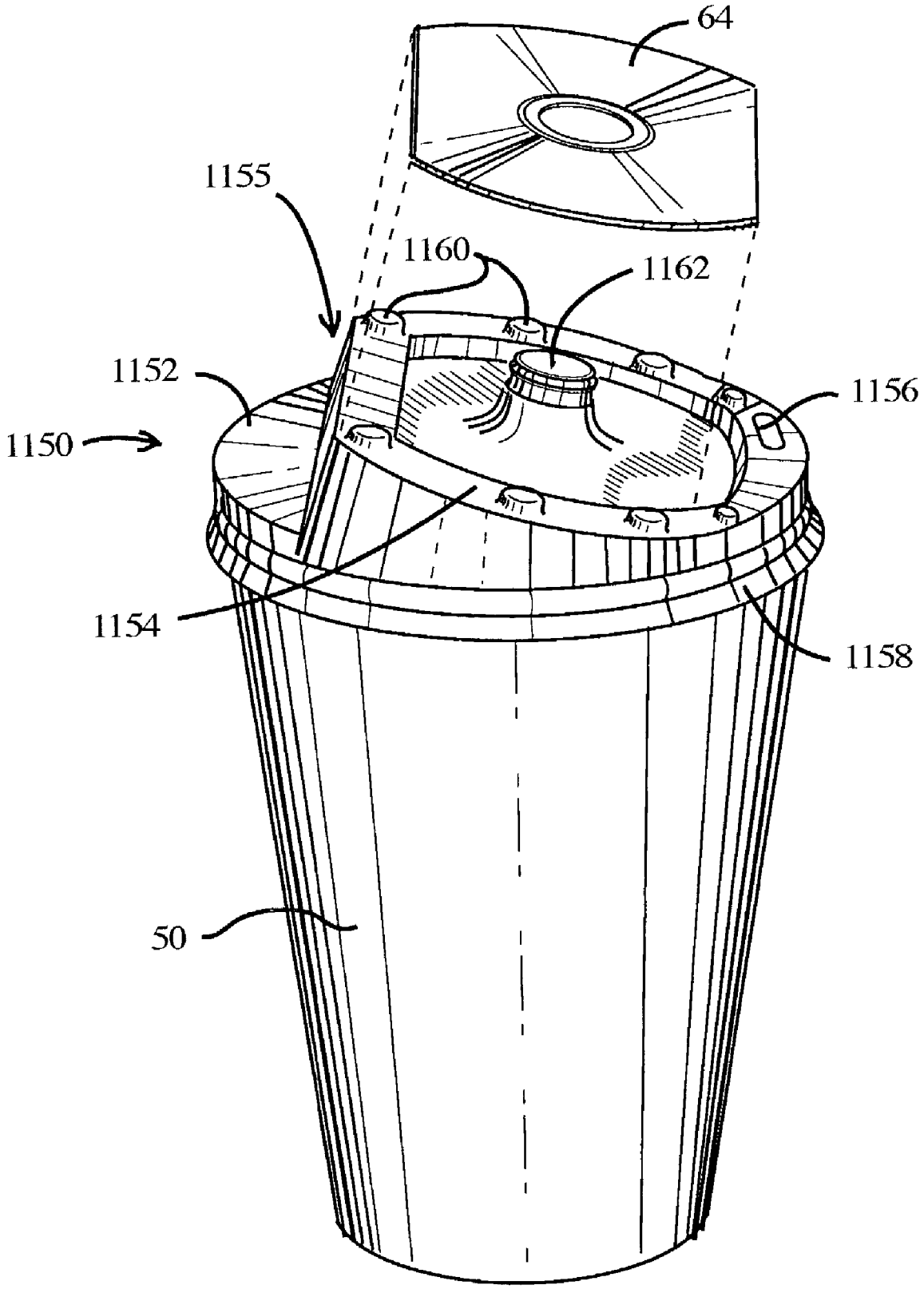
FIG. 11B is a perspective view of an exemplary embodiment of a lid assembly for a beverage container according to the present invention which includes an inclined upper surface with an elevated edge facing away from a beverage dispensing aperture of the lid assembly, the upper surface being formed with risers and an upwardly protruding snap-on fitting for securing a complementary shaped premium with a hole to the lid assembly.

Referring to FIG. 11B, a lid assembly 1150 includes a lid member 1152 with an inclined upper surface 1154 and an elevated edge 1155 facing away from a beverage dispensing aperture 1156 of the lid assembly. A rim portion 1158 is formed about the upper surface 1154 for securing the lid member 1152 to a beverage container. The upper surface 1154 is formed as shown with a plurality of elevated risers or spacer members 1160, an upwardly protruding snap-on fitting 1162 for securing a premium (with a hole that is sized and shaped complementary to the snap-on fitting) to the lid assembly, and a recess portion between the spacer members 1160 and the upwardly protruding snap-on fitting 1162. In the exemplary illustrated embodiment, the upper surface 1154 is at an angle relative to a plane containing a bottom edge of the rim portion 1158 with an apex of the angle being located near the beverage dispensing aperture 1156. Also, a portion of a perimeter of the upper surface 1154 is complementary in shape to the premium (e.g., a standard 3" CD-ROM business card 64, as shown). In the exemplary illustrated embodiment, the perimeter spacer members 1160 are positioned as shown about the upper surface 1154 adjacent the perimeter. The spacer members 1160, in conjunction with the upwardly protruding snap-on fitting 1162, provide a combined premium display area and cooling/insulating structure that accommodates the premium. Together, the spacer members 1160 and the upwardly protruding snap-on fitting 1162 keep the premium separated from the upper surface 1154. This provides a passage which allows airflow between the upper surface 1154 and the premium and thereby promotes cooling and protects the premium from condensation. The angle of the upper surface 1154 relative to the plane containing the bottom edge of the rim portion 1158 promotes the flow of air through the passage.

Figure 12:
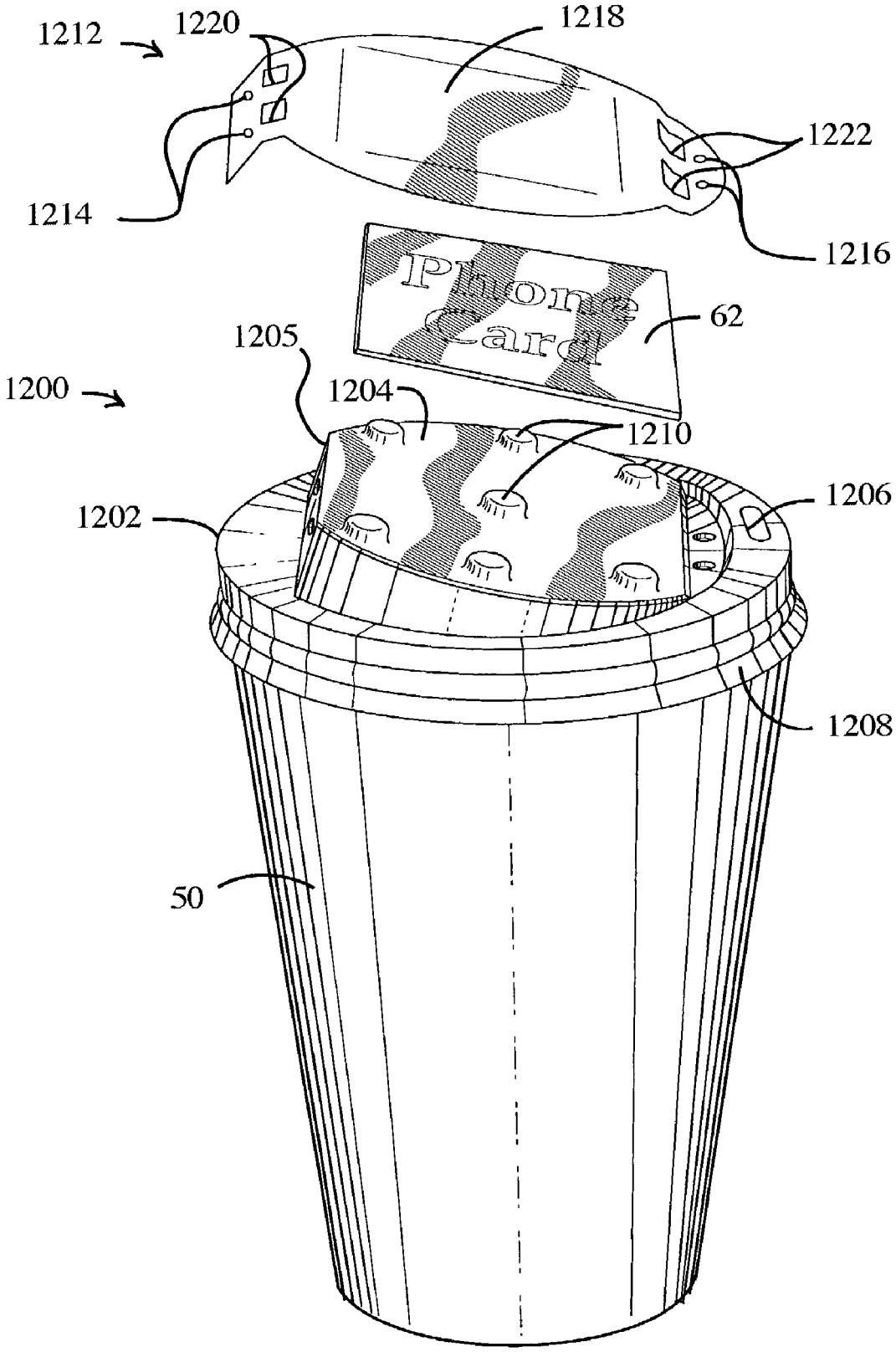
FIG. 12 is a perspective view of an exemplary embodiment of a lid assembly for a beverage container according to the present invention which includes an inclined upper surface formed with risers to accommodate a card-shaped premium and a vented top part configured to mechanically engage with the lid assembly thereby securing the premium to the lid assembly.

Referring to FIG. 12, a lid assembly 1200 includes a lid member 1202 with an inclined upper surface 1204 and an elevated edge 1205 facing away from a beverage dispensing aperture 1206 of the lid assembly. A rim portion 1208 is formed about the upper surface 1204 for securing the lid member 1202 to a beverage container. The upper surface 1204 is formed as shown with a plurality of elevated risers or spacer members 1210. In the exemplary illustrated embodiment, the upper surface 1204 is at an angle relative to a plane containing a bottom edge of the rim portion 1208 with an apex of the angle being located near the beverage dispensing aperture 1206. In the exemplary illustrated embodiment, the spacer members 1210 are positioned as shown about the upper surface 1204 to provide distributed support for a premium in the form of a card-shaped object 62 (e.g., a telephone card, as shown). The spacer members 1210 provide a combined premium display area and cooling/insulating structure that accommodates the premium and keeps it separated from the upper surface 1204. This provides a passage which allows airflow between the upper surface 1204 and the premium and thereby promotes cooling and protects the premium from condensation. The angle of the upper surface 1204 relative to the plane containing the bottom edge of the rim portion 1208 promotes the flow of air through the passage.

The lid assembly 1200 also includes a mechanism for securing the premium to the spacer members 1210 such that the premium is separated from the upper surface 1204 by a gap which allows airflow over the upper surface 1204. Generally, the securing mechanism comprises a top part 1212 which is formed in a complementary fashion with the lid member 1202 such that the top part 1212 can be snap fitted or otherwise secured over the premium to the lid member 1202. In the exemplary illustrated embodiment, the top part 1212 is secured to the lid member 1202 with snap-on fittings 1214 and 1216 that fit into recesses formed in the lid member 1202 on opposite sides of the inclined upper surface 1204. In the exemplary illustrated embodiment, the top part 1212 includes a cover portion 1218 which overlays the premium when the top part 1212 is secured to the lid member 1202 thereby protecting and securing the premium. The top part 1212 can be formed from an opaque material allowing (optionally) for the cover portion 1218 to carry a message, instruction, logo, "peel and win" sticker or other visible indicia by, for example, either printing directly on the cover portion 1218 or applying printed matter on the cover portion 1218 in the form of a sticker. Alternatively, the top part 1212 (in a "lens" embodiment) can be formed from a transparent or translucent material so that the premium will be visible when the top part is secured to the lid member, thereby allowing the consumer to see, for example, a message, instruction, logo, "peel and win" sticker or other visible indicia on the premium. In the exemplary illustrated embodiment, the top part 1212 includes air vents 1220 and 1222 which are positioned as shown between the cover portion 1218 and the snap-on fittings 1214 and 1216, respectively, to permit additional air flow between the premium and the upper surface 1204.

Figure 13:
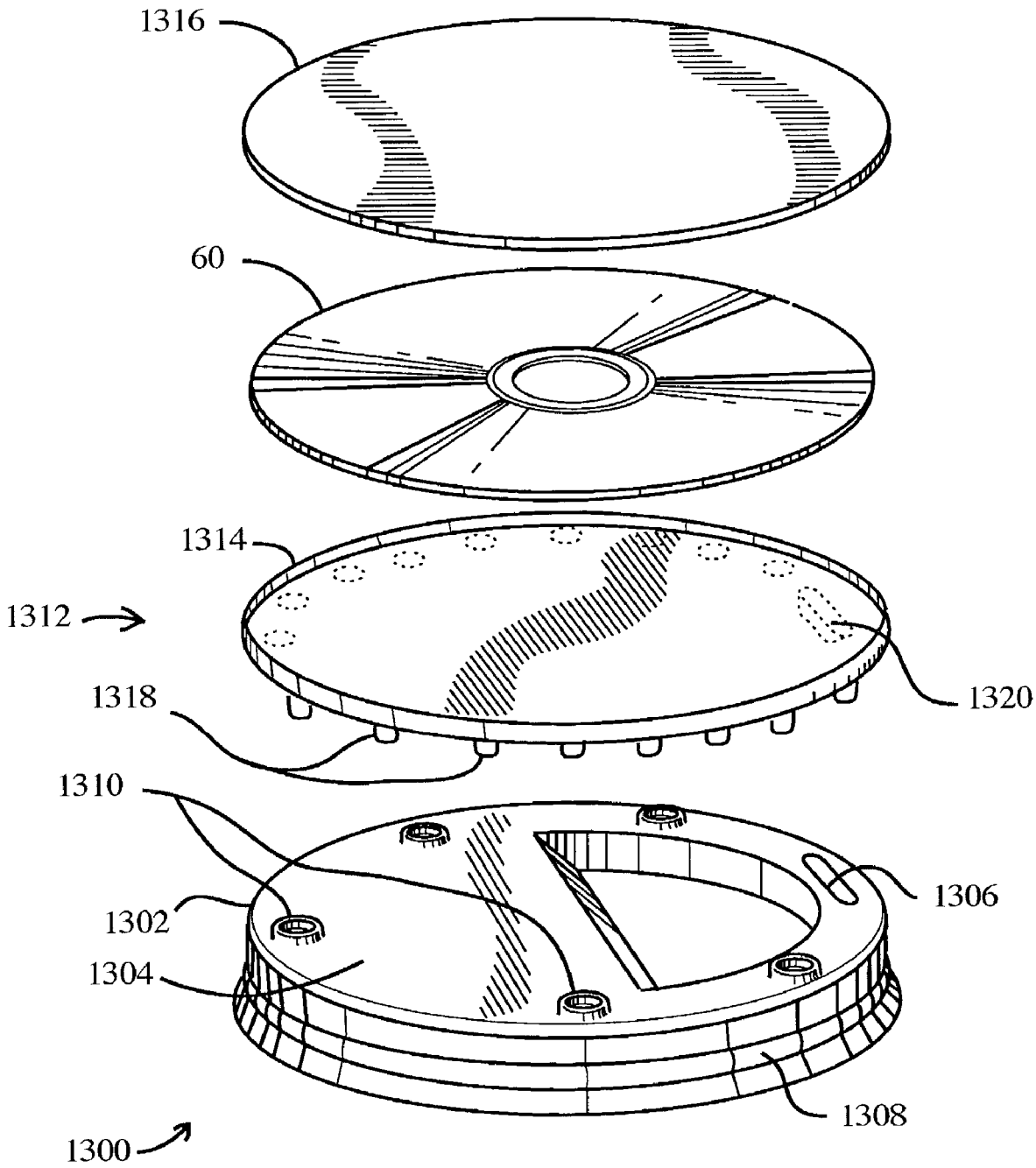
FIG. 13 is a perspective view of an exemplary embodiment of a lid assembly for a beverage container according to the present invention which includes a level upper surface formed with risers and a top part shaped to enclose a premium therein and including a protective cover for the premium, the top part being formed with downwardly protruding spacers for mechanically engaging the risers and with a plug for fitting within a beverage dispensing aperture of the lid assembly.

Referring to FIG. 13, a lid assembly 1300 includes a lid member 1302 with a level upper surface 1304 and a beverage dispensing aperture 1306. A rim portion 1308 is formed about the upper surface 1304 for securing the lid member 1302 to a beverage container. The upper surface 1304 is formed as shown with a plurality of elevated risers or spacer members 1310 extending upward. In the exemplary illustrated embodiment, these perimeter spacer members 1310 are positioned about the upper surface 1304 adjacent the rim portion 1308.

The lid assembly 1300 also includes a mechanism for securing a premium (e.g., a disk-shaped premium 60, as shown) to the spacer members 1310. The securing mechanism comprises a top part 1312 formed in a complementary fashion with the lid member 1302 such that the top part 1312 mechanically engages with the lid member 1302. In the exemplary illustrated embodiment, the top part 1312 is shaped to enclose a premium therein and includes a base portion 1314 formed with a recessed portion sized to receive the premium therein and a protective cover 1316 sized to fit over the premium and into the recessed portion. The underside of the base portion 1314 is formed with downwardly extending protrusions 1318 that are shaped complementary to the spacer members 1310 for interlocking with the spacer members 1310 and with a downwardly extending plug 1320 sized to be fitted into the beverage dispensing aperture 1306. Thus, the spacer members 1310 and the top part 1312 provide a combined premium display area and cooling/insulating structure and keep the premium separated from the upper surface 1304. This provides a passage which allows airflow between the upper surface 1304 and the premium and thereby promotes cooling and protects the premium from condensation. The protective cover 1316 can be formed from an opaque material or from a transparent or translucent material.

Figure 14:
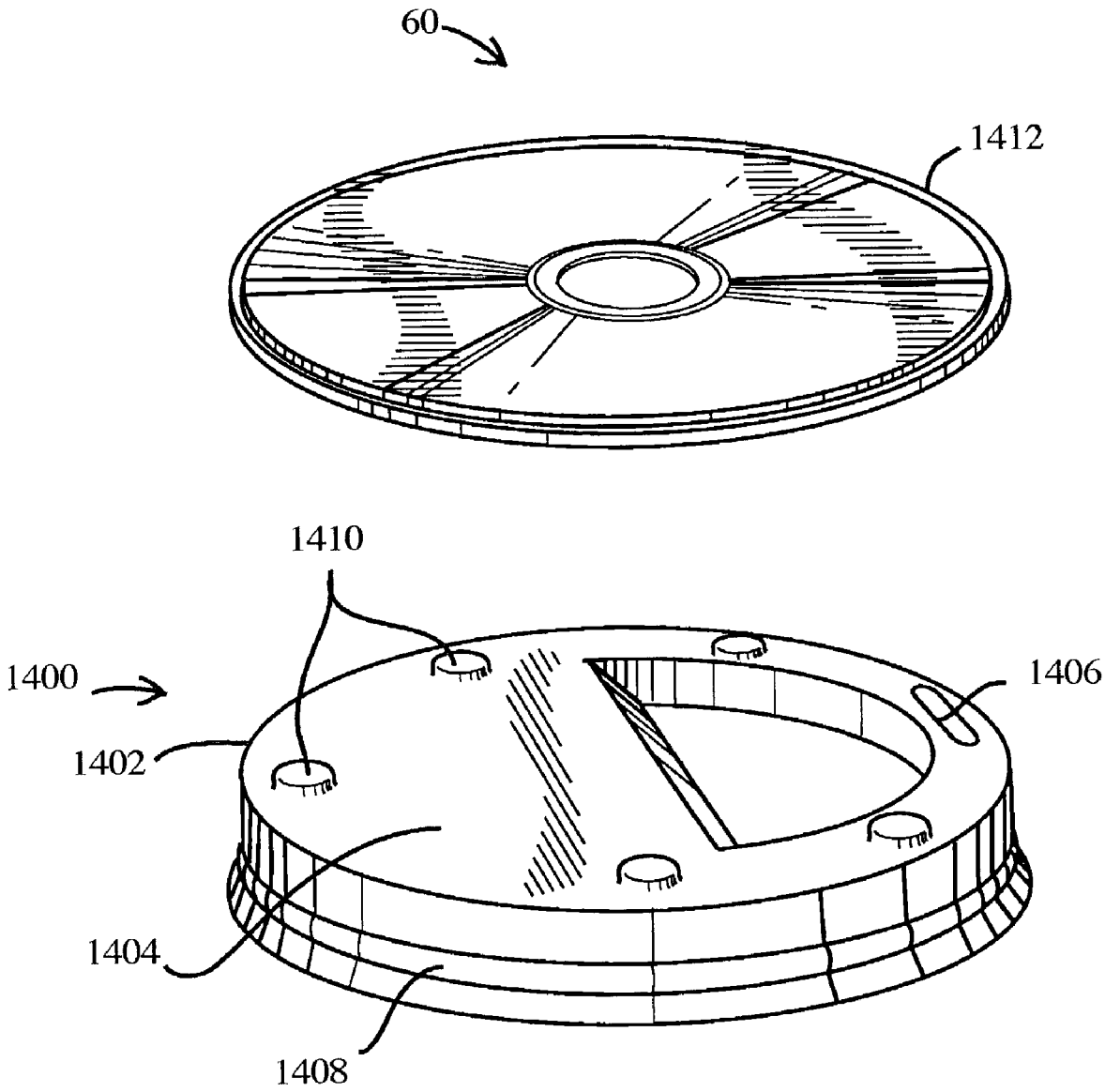
FIG. 14 is a perspective view of an exemplary embodiment of a lid assembly for a beverage container according to the present invention which includes a level upper surface formed with risers and a top part shaped to support a premium thereon and including a protective cover for the premium, the top part being secured to the risers with an adhesive substance.

Referring to FIG. 14, a lid assembly 1400 includes a lid member 1402 with a level upper surface 1404 and a beverage dispensing aperture 1406. A rim portion 1408 is formed about the upper surface 1404 for securing the lid member 1402 to a beverage container. The upper surface 1404 is formed as shown with a plurality of elevated risers or spacer members 1410 extending upward. In the exemplary illustrated embodiment, these perimeter spacer members 1410 are positioned about the upper surface 1404 adjacent the rim portion 1408.

The lid assembly 1400 also includes a mechanism for securing a premium (alone) or a premium and a top part 1412 (e.g., a disk-shaped premium 60 wrapped in a protective plastic cover) to the spacer members 1410. The protective cover can be formed with one or more tabs (not shown) for pulling the top part 1412 away from the lid member 1402. The securing mechanism comprises an adhesive substance applied to top portions of one or more of the spacer members 1410. Additional spacer members 1410 without adhesive can be added to increase the contact area with the premium so that the lid member 1402 can be correctly pressure fit to the beverage cup (i.e., with the proper seal) without adding to the adhesion which might increase the risk of breaking the premium when it is later separated from the lid member 1402. Alternatively, friction snaps can be employed instead of an adhesive material. Thus, the spacer members 1410 and the top part 1412 provide a combined premium display area and cooling/insulating structure and keep the premium separated from the upper surface 1404. This provides a passage which allows airflow between the upper surface 1404 and the premium and thereby promotes cooling and protects the premium from condensation. The top part 1412 can be formed from an opaque material or from a transparent or translucent material.

Figure 15:
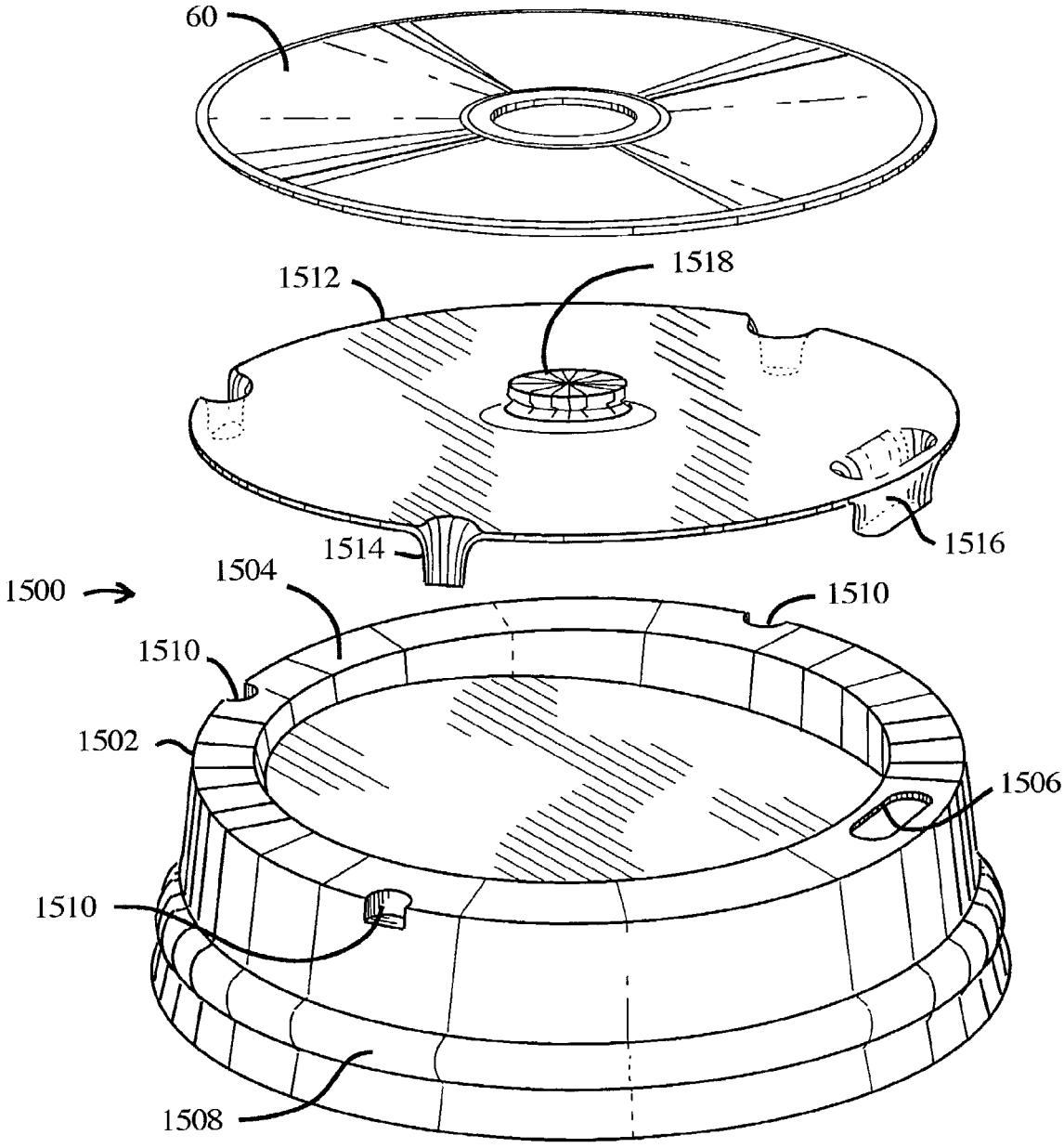
FIG. 15 is a perspective view of an exemplary embodiment of a lid assembly for a beverage container according to the present invention which includes a lid member with an upper surface and a spacer member configured for mechanically interfitting with the lid member while maintaining a gap between the spacer member and the upper surface, the spacer member including an upwardly protruding snap-on fitting for securing a premium with a hole to the lid assembly.

Referring to FIG. 15, a lid assembly 1500 includes a lid member 1502 with a level upper surface 1504 (surrounding a recessed central portion) and a beverage dispensing aperture 1506. A rim portion 1508 is formed about the upper surface 1504 for securing the lid member 1502 to a beverage container. In the exemplary illustrated embodiment, a perimeter portion of the lid member 1502 is formed as shown with a plurality of indentations 1510. The lid assembly 1500 also includes a top part or spacer member 1512 formed in a complementary fashion with the lid member 1502 such that the spacer member 1512 mechanically engages with the lid member 1502 while maintaining a gap between the underside of the spacer member 1512 and the upper surface 1504. In the exemplary illustrated embodiment, the spacer member 1512 is formed with downwardly extending protrusions 1514 configured for mechanically interfitting in a complementary manner with one or more of the indentations 1510, including a plug member 1516 sized to fit within the beverage dispensing aperture 1506.

The lid assembly 1500 further includes a mechanism for securing the premium to the spacer member 1512. In the exemplary illustrated embodiment, the premium securing mechanism comprises an upwardly extending post member 1518 formed to mechanically engage and secure the premium to the top side of the spacer member 1512. Thus, the spacer member 1512 and upwardly extending post member 1518 provide a combined premium display area and cooling/insulating structure and keep the premium separated from the upper surface 1504. This provides a passage which allows airflow between the upper surface 1504 and the premium and thereby promotes cooling and protects the premium from condensation.

Figure 16:
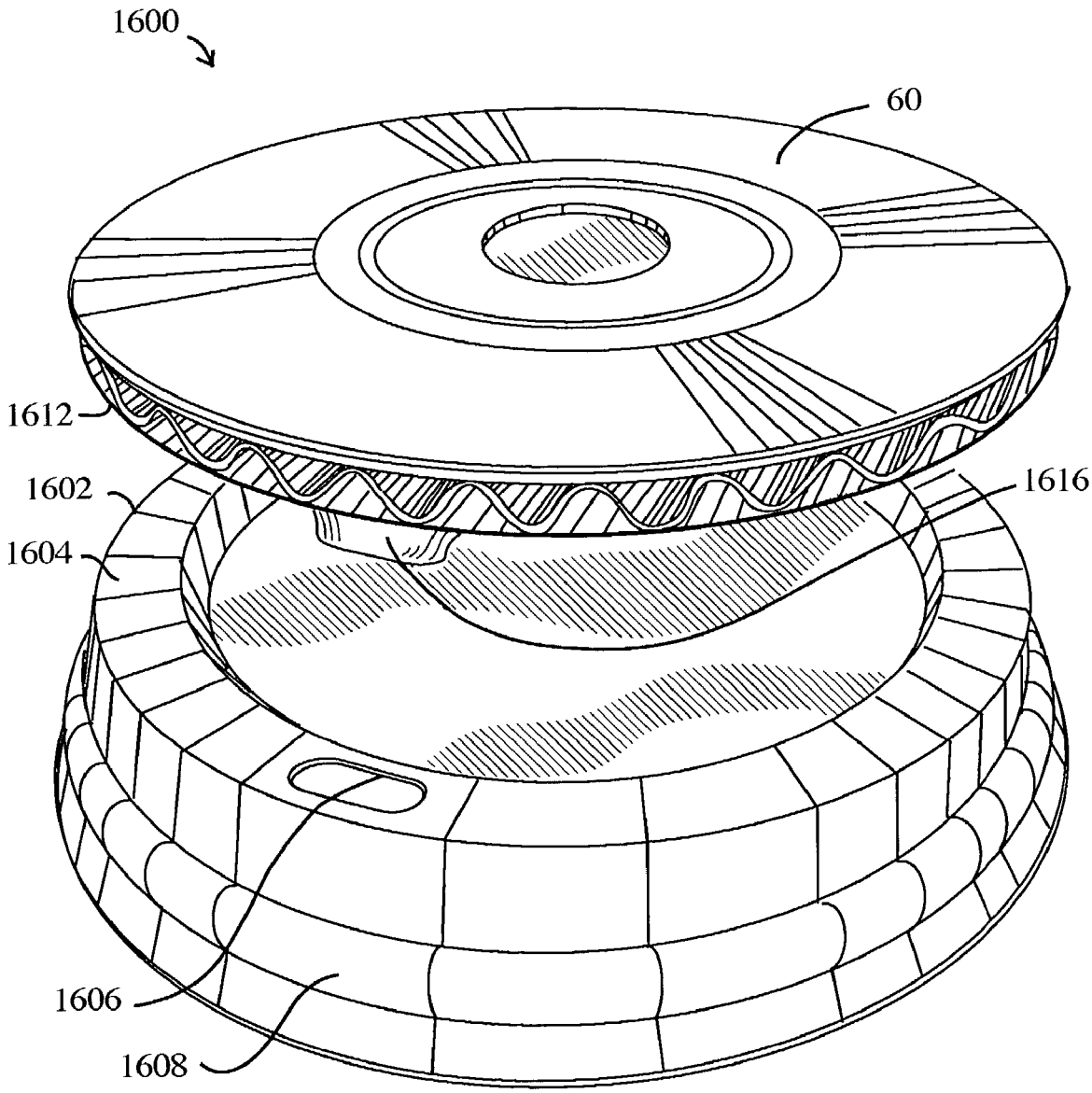
FIG. 16 is a perspective view of an exemplary embodiment of a lid assembly for a beverage container according to the present invention which includes a lid member with a beverage dispensing aperture and a corrugated spacer member formed with a downwardly extending protrusion for mechanically interfitting the spacer member to the lid member, the corrugated spacer member providing both a premium display area and cooling/insulating structure for the beverage container.

Referring to FIG. 16, a lid assembly 1600 includes a lid member 1602 with a level upper surface 1604 (surrounding a recessed central portion) and a beverage dispensing aperture 1606. A rim portion 1608 is formed about the upper surface 1604 for securing the lid member 1602 to a beverage container. The lid assembly 1600 also includes a top part or spacer member 1612 formed in a complementary fashion with the lid member 1602 such that the spacer member 1612 mechanically engages with the lid member 1602. The spacer member 1612 is formed with at least one downwardly extending protrusion configured for mechanically interfitting the spacer member 1612 to the lid member 1602. In the exemplary illustrated embodiment, the spacer member 1612 comprises a corrugated material (such as a piece of corrugated cardboard sized to accommodate a disk-shaped premium 60) and the downwardly extending protrusion comprises a plug member 1616 sized to fit within the beverage dispensing aperture 1606. In addition to the plug member 1616, a light stick adhesive can be used on the underside of the spacer member 1612. Thus, the spacer member 1612 provides a display area to which the premium can be secured (e.g., with an adhesive) and a cooling/insulating structure for the beverage container which keep the premium separated from the upper surface 1604. This provides a passage which allows airflow between the upper surface 1604 and the premium and thereby promotes cooling and protects the premium from condensation.

Thus, various lid assembly embodiments disclosed herein provide a small surface area (i.e., less surface area than the contact between the beverage cup and the bottom part of the lid assembly) with discrete adhering points which protect against inadvertent spillage by an aggressive or clumsy consumer during separation of the premium from the lid assembly. With less friction (adhesion) between the top part and the bottom part of a two-part lid assembly than between the bottom part and the beverage cup, consumers can with little resistance remove the top part without separating the bottom part from the beverage cup or breaking the seal between the bottom part and the beverage cup.

Figure 17:
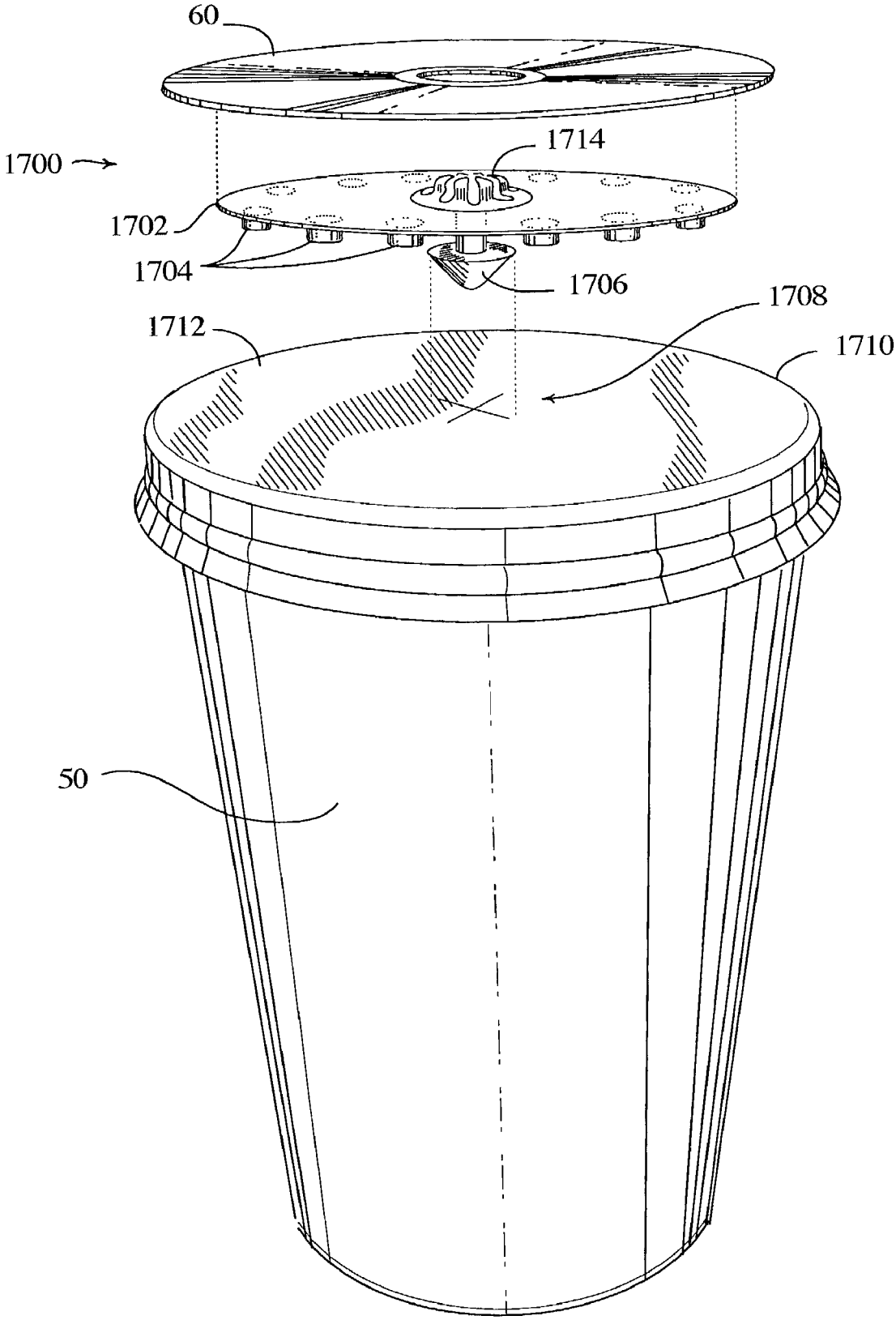
FIG. 17 is a perspective view of an exemplary embodiment of a premium holder apparatus for a beverage container lid according to the present invention which includes a platform with downwardly protruding spacer members, a downwardly protruding plug-in member sized for fitting into a straw hole of the beverage container lid, and an upwardly protruding snap-on fitting member for securing a premium to the platform.

Referring to FIG. 17, a premium holder apparatus 1700 includes a platform 1702 formed as shown with a plurality of downwardly protruding spacer members 1704 and a centrally disposed downwardly protruding plug-in member 1706 sized for fitting into a straw hole 1708 of a beverage container lid 1710 and for securing the platform 1702 to the beverage container lid 1710 such that a gap is maintained between the platform 1702 and an upper surface 1712 of the beverage container lid 1710. In the exemplary illustrated embodiment, the spacer members 1704 are positioned around the platform adjacent the perimeter of the platform 1702. The premium holder apparatus 1700 further includes a mechanism for securing a premium in the form of a digital media disk 60 to the platform 1702. A protective plastic or other encasing material can be provided for the premium. In the exemplary illustrated embodiment, the premium securing mechanism comprises a snap-on fitting member 1714 upwardly protruding from the platform 1702 and formed to mechanically engage and secure the premium to the top side of the platform 1702. Thus, the platform 1702, the spacer members 1704 and the snap-on fitting member 1714 provide a combined premium display area and cooling/insulating structure and keep the premium separated from the upper surface 1712. This provides a passage which allows airflow between the upper surface 1712 and the premium and thereby promotes cooling and protects the premium from condensation.

Figure 18:
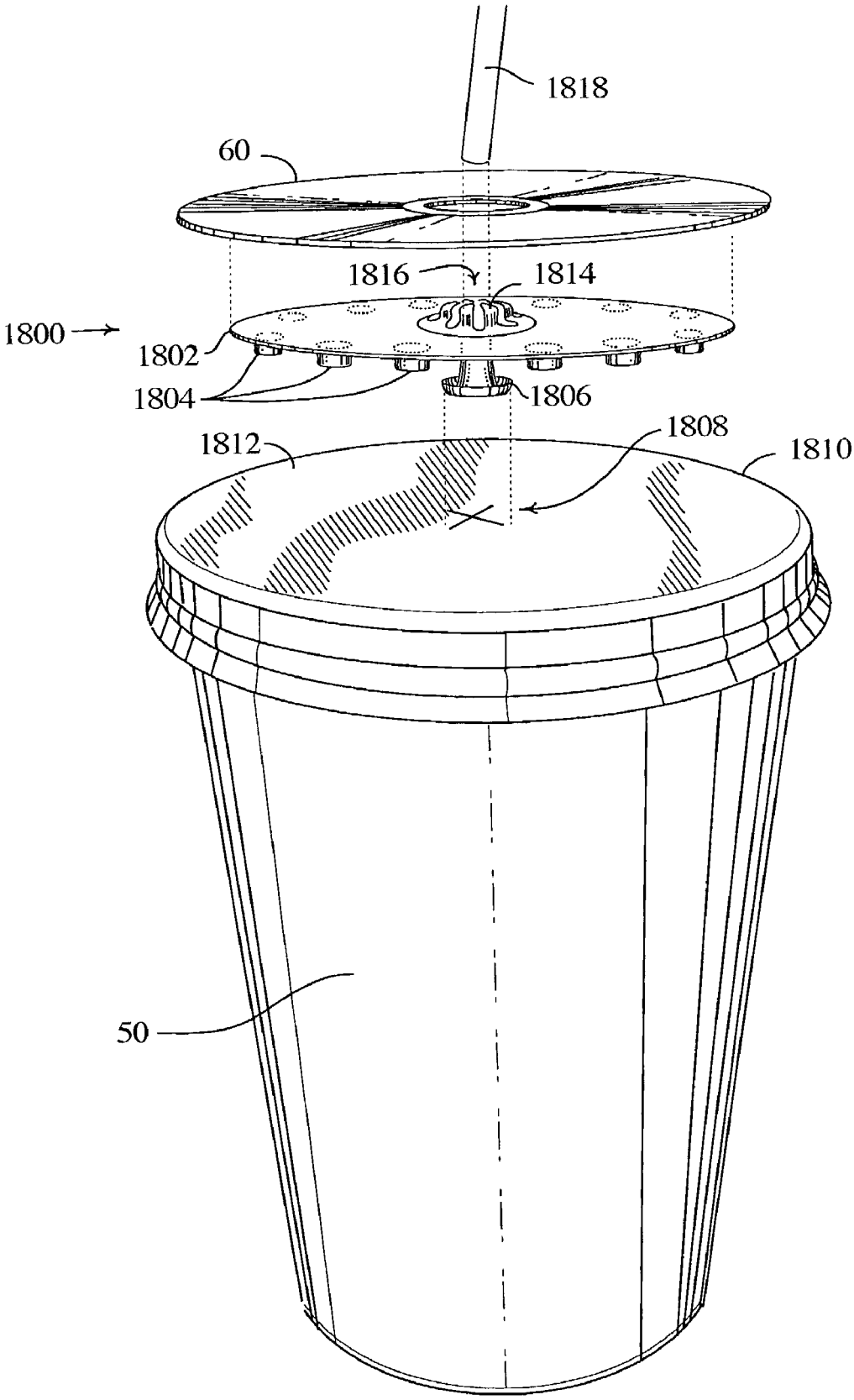
FIG. 18 is a perspective view of an exemplary embodiment of a premium holder apparatus for a beverage container lid similar to that of FIG. 17 but with the platform, the plug-in member and the snap-on fitting member being formed with a channel extending therethrough for receiving a straw.

Referring to FIG. 18, a premium holder apparatus 1800 includes a platform 1802 formed as shown with a plurality of downwardly protruding spacer members 1804 and a centrally disposed downwardly protruding plug-in member 1806 sized for fitting into a straw hole 1808 of a beverage container lid 1810 and for securing the platform 1802 to the beverage container lid 1810 such that a gap is maintained between the platform 1802 and an upper surface 1812 of the beverage container lid 1810. In the exemplary illustrated embodiment, the spacer members 1804 are positioned around the platform adjacent the perimeter of the platform 1802. The premium holder apparatus 1800 further includes a mechanism for securing a premium in the form of a digital media disk 60 to the platform 1802. A protective plastic or other encasing material can be provided for the premium. In the exemplary illustrated embodiment, the premium securing mechanism comprises a snap-on fitting member 1814 upwardly protruding from the platform 1802 and formed to mechanically engage and secure the premium to the top side of the platform 1802. Thus, the platform 1802, the spacer members 1804 and the snap-on fitting member 1814 provide a combined premium display area and cooling/insulating structure and keep the premium separated from the upper surface 1812. This provides a passage which allows airflow between the upper surface 1812 and the premium and thereby promotes cooling and protects the premium from condensation. In the exemplary illustrated embodiment, the platform 1802, the plug-in member 1806 and the snap-on fitting member 1814 are formed with a channel 1816 extending therethrough for receiving a drinking straw 1818.

Figure 19:
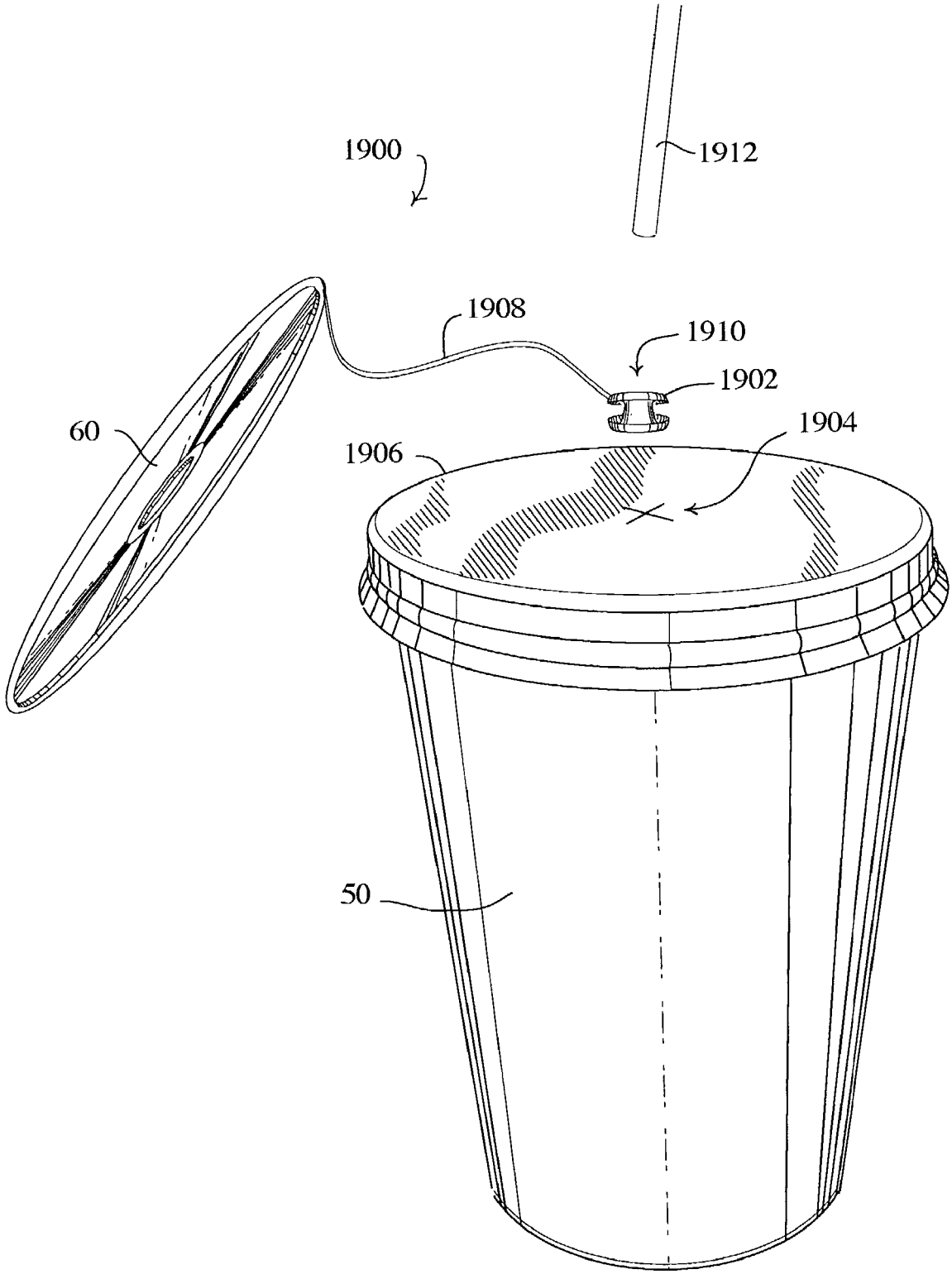
FIG. 19 is a perspective view of an exemplary embodiment of a premium holder apparatus for a beverage container lid according to the present invention which includes a plug-in member sized for fitting into a straw hole of the beverage container lid and a flexible member that attaches a premium to the plug-in member, the plug-in member being formed with a channel extending therethrough for receiving a straw.

Referring to FIG. 19, a premium holder apparatus 1900 includes a plug-in member 1902 sized for fitting into a straw hole 1904 of a beverage container lid 1906. The premium holder apparatus 1900 further includes a mechanism for securing a premium (e.g., a digital media disk 60, as shown) to the plug-in member 1902. A protective plastic or other encasing material can be provided for the premium. In the exemplary illustrated embodiment, the premium securing mechanism comprises a flexible member 1908 (e.g., a piece of plastic, string or the like) that attaches the premium to the plug-in member 1902. In the exemplary illustrated embodiment, the flexible member 1908 is sufficiently long to allow the premium to dangle from the side of the beverage container lid 1906 and the plug-in member 1902 is formed with a channel 1910 extending therethrough for receiving a drinking straw 1912.

Although the present invention has been described in terms of the embodiment(s) above, numerous modifications and/or additions to the above-described embodiment(s) would be readily apparent to one skilled in the art. It is intended that the scope of the present invention extends to all such modifications and/or additions.

We claim:

1. A lid assembly for a beverage container the lid assembly comprising:

a premium;

a lid member including a beverage dispensing aperture and an upper surface with a rim portion formed thereabout for securing the lid member to a beverage container, the lid member being formed with a plurality of spacer members extending upward from the upper surface, the spacer members including perimeter spacer members positioned about the upper surface adjacent to the rim portion, the spacer members providing a combined premium display area and cooling/insulating structure for the beverage container; and a mechanism for securing the premium to the spacer members and positioning the premium on top of the perimeter spacer members such that the premium remains separated from the upper surface by a gap which allows airflow over the upper surface;

wherein the premium is separable from the lid member and the premium has utility independent of the lid member;

wherein the upper surface is at an angle greater than 0 degrees relative to a plane containing a bottom edge of the rim portion.

2. The lid assembly for a beverage container of claim 1, wherein the upper surface includes a perimeter portion complementary in shape to the premium.

3. The lid assembly for a beverage container of claim 1, wherein an apex of the angle is located near a portion of the lid member opposite from the beverage dispensing aperture.

4. The lid assembly for a beverage container of claim 1, wherein the premium has a centrally located hole and the securing mechanism comprises a snap-on fitting member formed on the upper surface and sized to fit through the centrally located hole and snap together with the premium while maintaining the gap between the premium and the upper surface.

5. A lid assembly for a beverage container, the lid assembly comprising:

a premium;

a lid member including a beverage dispensing aperture and an upper surface with a rim portion formed thereabout for securing the lid member to a beverage container, the lid member being formed with a plurality of spacer members extending upward from the upper surface, the spacer members including perimeter spacer members positioned about the upper surface adjacent to the rim portion, the spacer members providing a combined premium display area and cooling/insulating structure for the beverage container; and a mechanism for securing the premium to the spacer members and positioning the premium over the perimeter spacer members such that the premium is separated from the upper surface by a gap which allows airflow over the upper surface;

wherein the upper surface is at an angle relative to a plane containing a bottom edge of the rim portion;

wherein an apex of the angle is located near a portion of the lid member opposite from the beverage dispensing aperture.

* * * * *